US011957215B2

(12) United States Patent
Chang

(10) Patent No.: US 11,957,215 B2
(45) Date of Patent: Apr. 16, 2024

(54) ACTUATOR FOR AN AUTOMATED FOOTWEAR PLATFORM

(71) Applicant: NIKE, Inc., Beaverton, OR (US)

(72) Inventor: Narissa Chang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/902,100

(22) Filed: Sep. 2, 2022

(65) Prior Publication Data

US 2023/0037823 A1 Feb. 9, 2023

Related U.S. Application Data

(63) Continuation of application No. 16/865,677, filed on May 4, 2020, now Pat. No. 11,432,618, which is a (Continued)

(51) Int. Cl.

| | |
|---|---|
| ***A43C 11/16*** | (2006.01) |
| ***A43B 1/00*** | (2006.01) |
| ***A43B 3/34*** | (2022.01) |
| ***A43B 3/36*** | (2022.01) |
| ***A43B 13/14*** | (2006.01) |
| ***A43C 1/00*** | (2006.01) |
| ***A43C 7/00*** | (2006.01) |

(52) U.S. Cl.

CPC ..... *A43C 11/165* (2013.01); *A43B 1/0072* (2013.01); *A43B 3/34* (2022.01); *A43B 3/36* (2022.01); *A43B 13/14* (2013.01); *A43C 1/00* (2013.01); *A43C 7/00* (2013.01)

(58) Field of Classification Search

CPC ..... A43C 11/165; A43B 1/0072
USPC ..... 36/97
See application file for complete search history.

(56) References Cited

U.S. PATENT DOCUMENTS

| | | | |
|---|---|---|---|
| 4,741,115 | A | 5/1988 | Pozzobon |
| 5,303,485 | A | 4/1994 | Goldston et al. |

(Continued)

FOREIGN PATENT DOCUMENTS

| | | |
|---|---|---|
| CN | 1813603 | 8/2006 |
| CN | 109152443 | 1/2019 |

(Continued)

OTHER PUBLICATIONS

"International Application Serial No. PCT US2017 021937, International Search Report dated Jun. 16, 2017", 3 pgs.

(Continued)

*Primary Examiner* — Timothy K Trieu
(74) *Attorney, Agent, or Firm* — Schwegman, Lundberg & Woessner, P.A.

(57) ABSTRACT

Systems and apparatus related to an automated footwear platform including a button assembly for controlling a footwear lacing apparatus are discussed. In an example, the button assembly can include a bushing and an actuator. The bushing can include an actuator housing surrounded by an outer flange. The actuator housing can include an exterior side and an interior side relative to the footwear platform. The actuator can include a plurality of actuator bodies disposed within the actuator housing. Each actuator body of the plurality of actuator bodies can include a switch interface adapted to interact with a switch on a lacing engine.

20 Claims, 30 Drawing Sheets

Related U.S. Application Data continuation of application No. 15/456,317, filed on Mar. 10, 2017, now Pat. No. 10,674,793.

(60) Provisional application No. 62/308,716, filed on Mar. 15, 2016.

(56) References Cited

U.S. PATENT DOCUMENTS

| | | | | |
|---|---|---|---|---|
| 6,427,361 | B1 | 8/2002 | Chou | |
| 7,096,559 | B2 * | 8/2006 | Johnson | A43B 11/00 29/433 |
| 10,660,406 | B2 * | 5/2020 | Beers | A43C 11/165 |
| 10,674,793 | B2 | 6/2020 | Chang | |
| 11,000,099 | B2 * | 5/2021 | Beers | A43C 11/165 |
| 11,432,618 | B2 | 9/2022 | Chang | |
| 2003/0150135 | A1 | 8/2003 | Liu | |
| 2006/0053659 | A1 | 3/2006 | Johnson | |
| 2006/0069329 | A1 | 3/2006 | Nan | |
| 2007/0000154 | A1 | 1/2007 | Dibenedetto et al. | |
| 2008/0301919 | A1 | 12/2008 | Ussher | |
| 2014/0068838 | A1 | 3/2014 | Beers et al. | |
| 2014/0082963 | A1 * | 3/2014 | Beers | A43B 3/38 36/83 |
| 2015/0250268 | A1 | 9/2015 | Alt et al. | |
| 2015/0290074 | A1 | 10/2015 | Koenig | |
| 2017/0265573 | A1 * | 9/2017 | Beers | A43C 11/14 |
| 2017/0265581 | A1 | 9/2017 | Chang | |
| 2017/0265585 | A1 * | 9/2017 | Orand | A43C 11/008 |
| 2018/0289110 | A1 | 10/2018 | Bock et al. | |
| 2018/0368526 | A1 | 12/2018 | Bock et al. | |
| 2020/0260823 | A1 | 8/2020 | Chang | |
| 2021/0337934 | A1 * | 11/2021 | Beers | A43B 11/00 |

FOREIGN PATENT DOCUMENTS

| | | |
|---|---|---|
| CN | 109152443 | 6/2021 |
| EP | 1457128 | 9/2004 |
| JP | 2004135874 | 5/2004 |
| JP | 2005137557 | 6/2005 |
| JP | 2005190849 | 7/2005 |
| JP | 2007109486 | 4/2007 |
| JP | 2011528240 | 11/2011 |
| JP | 2019509818 | 4/2019 |
| JP | 7113753 | 7/2022 |
| KR | 102416917 | 6/2022 |
| TW | 521593 | 2/2003 |
| WO | 2017160659 | 9/2017 |

OTHER PUBLICATIONS

"International Application Serial No. PCT US2017 021937, Written Opinion dated Jun. 16, 2017", 5 pgs.
"International Application Serial No. PCT US2017 021937, International Preliminary Report on Patentability dated Sep. 27, 2018", 7 pgs.
"U.S. Appl. No. 15/456,317, Non Final Office Action dated Apr. 4, 2019", 12 pgs.
"European Application Serial No. 17767228.4, Response filed Apr. 26, 2019 to Communication Pursuant to Rules 161 and 162 dated Oct. 30, 2018", 13 pgs.
"U.S. Appl. No. 15/456,317, Response filed Jun. 27, 2019 to Non-Final Office Action dated Apr. 4, 2019", 13 pgs.
"U.S. Appl. No. 15/456,317, Final Office Action dated Sep. 10, 2019", 13 pgs.
"European Application Serial No. 17767228.4, Extended European Search Report dated Oct. 17, 2019", 8 pgs.
"U.S. Appl. No. 15/456,317, Response filed Dec. 30, 2019 to Final Office Action dated Sep. 10, 2019", 8 pgs.
"U.S. Appl. No. 15/456,317, Notice of Allowance dated Jan. 23, 2020", 8 pgs.
"European Application Serial No. 17767228.4, Response filed Apr. 1, 2020 to Extended European Search Report dated Oct. 17, 2019", 16 pgs.
"U.S. Appl. No. 15/456,317, Corrected Notice of Allowability dated May 13, 2020", 5 pgs.
"European Application Serial No. 17767228.4, Communication Pursuant to Article 94(3) EPC dated Jun. 4, 2020", 7 pgs.
"Chinese Application Serial No. 201780028511.6, Office Action dated Jul. 30, 2020", w English Translation, 13 pgs.
"European Application Serial No. 17767228.4, Response filed Sep. 2, 2020 to Communication Pursuant to Article 94(3) EPC dated Jun. 4, 2020", 12 pgs.
"European Application Serial No. 17767228.4, Communication pursuant to Article 94(3) EPC dated Oct. 2, 2020", 6 pgs.
"Chinese Application Serial No. 201780028511.6, Response filed Feb. 8, 2021 to Office Action dated Jul. 30, 2020", w English Claims, 44 pgs.
"European Application Serial No. 17767228.4, Response filed Feb. 10, 2021 to Communication pursuant to Article 94(3) EPC dated Oct. 2, 2020", 6 pgs.
"Japanese Application Serial No. 2018-548800, Notification of Reasons for Refusal dated Mar. 30, 2021", w machine English translation, 9 pgs.
"European Application Serial No. 17767228.4, Communication Pursuant to Article 94(3) EPC dated Jun. 10, 2021", 7 pgs.
"Korean Application Serial No. 10-2018-7029684, Notice of Preliminary Rejection dated Jun. 29, 2021", With English translation, 4 pages.
"Japanese Application Serial No. 2018-548800, Response filed Jun. 29, 2021 to Notification of Reasons for Refusal dated Mar. 30, 2021", With English claims, 13 pages.
"U.S. Appl. No. 16/865,677, Non Final Office Action dated Nov. 23, 2021", 8 pgs.
"European Application Serial No. 17767228.4, Response filed Nov. 23, 2021 to Communication Pursuant to Article 94(3) EPC dated Jun. 10, 2021", 11 pgs.
"Japanese Application Serial No. 2018-548800, Examiners Decision of Final Refusal dated Nov. 30, 2021", w English translation, 5 pgs.
"Korean Application Serial No. 10-2018-7029684, Response filed Nov. 26, 2021 to Notice of Preliminary Rejection dated Jun. 29, 2021", w English claims, 15 pgs.
"U.S. Appl. No. 16/865,677, Response filed Feb. 22, 2022 to Non Final Office Action dated Nov. 23, 2021", 10 pgs.
"Japanese Application Serial No. 2018-548800, Response filed Mar. 29, 2022 to Examiners Decision of Final Refusal dated Nov. 30, 2021", w English claims, 6 pgs.
"U.S. Appl. No. 16/865,677, Notice of Allowance dated May 3, 2022", 8 pgs.
"European Application Serial No. 22153528.9, Extended European Search Report dated May 11, 2022", 9 pgs.
"U.S. Appl. No. 16/865,677, Corrected Notice of Allowability dated May 25, 2022", 4 pgs.
"European Application Serial No. 22153528.9, Response filed Nov. 30, 2022 to Extended European Search Report dated May 11, 2022", 12 pgs.
U.S. Appl. No. 15/456,317 U.S. Pat. No. 10,674,793, filed Mar. 10, 2017, Actuator for an Automated Footwear Platform.
U.S. Appl. No. 16/865,677 U.S. Pat. No. 11,432,618, filed May 4, 2020, Actuator for an Automated Footwear Platform.

* cited by examiner

ACTUATOR FOR AN AUTOMATED FOOTWEAR PLATFORM

CLAIM OF PRIORITY

This application is a continuation of U.S. patent application Ser. No. 16/865,677, filed May 4, 2020, which application is a continuation of U.S. patent application Ser. No. 15/456,317, filed Mar. 10, 2017, issued on Jun. 9, 2020 as U.S. Pat. No. 10,674,793, which application claims the benefit of priority of U.S. Provisional Patent Application Ser. No. 62/308,716, filed on Mar. 15, 2016, all of which are incorporated by reference herein in their entireties.

The following specification describes various aspects of a motorized lacing system, motorized and non-motorized lacing engines, footwear components related to the lacing engines, automated lacing footwear platforms, and related assembly processes.

BACKGROUND

Devices for automatically tightening an article of footwear have been previously proposed. Liu, in U.S. Pat. No. 6,691,433, titled "Automatic tightening shoe", provides a first fastener mounted on a shoe's upper portion, and a second fastener connected to a closure member and capable of removable engagement with the first fastener to retain the closure member at a tightened state. Liu teaches a drive unit mounted in the heel portion of the sole. The drive unit includes a housing, a spool rotatably mounted in the housing, a pair of pull strings and a motor unit. Each string has a first end connected to the spool and a second end corresponding to a string hole in the second fastener. The motor unit is coupled to the spool. Liu teaches that the motor unit is operable to drive rotation of the spool in the housing to wind the pull strings on the spool for pulling the second fastener towards the first fastener. Liu also teaches a guide tube unit that the pull strings can extend through.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1:
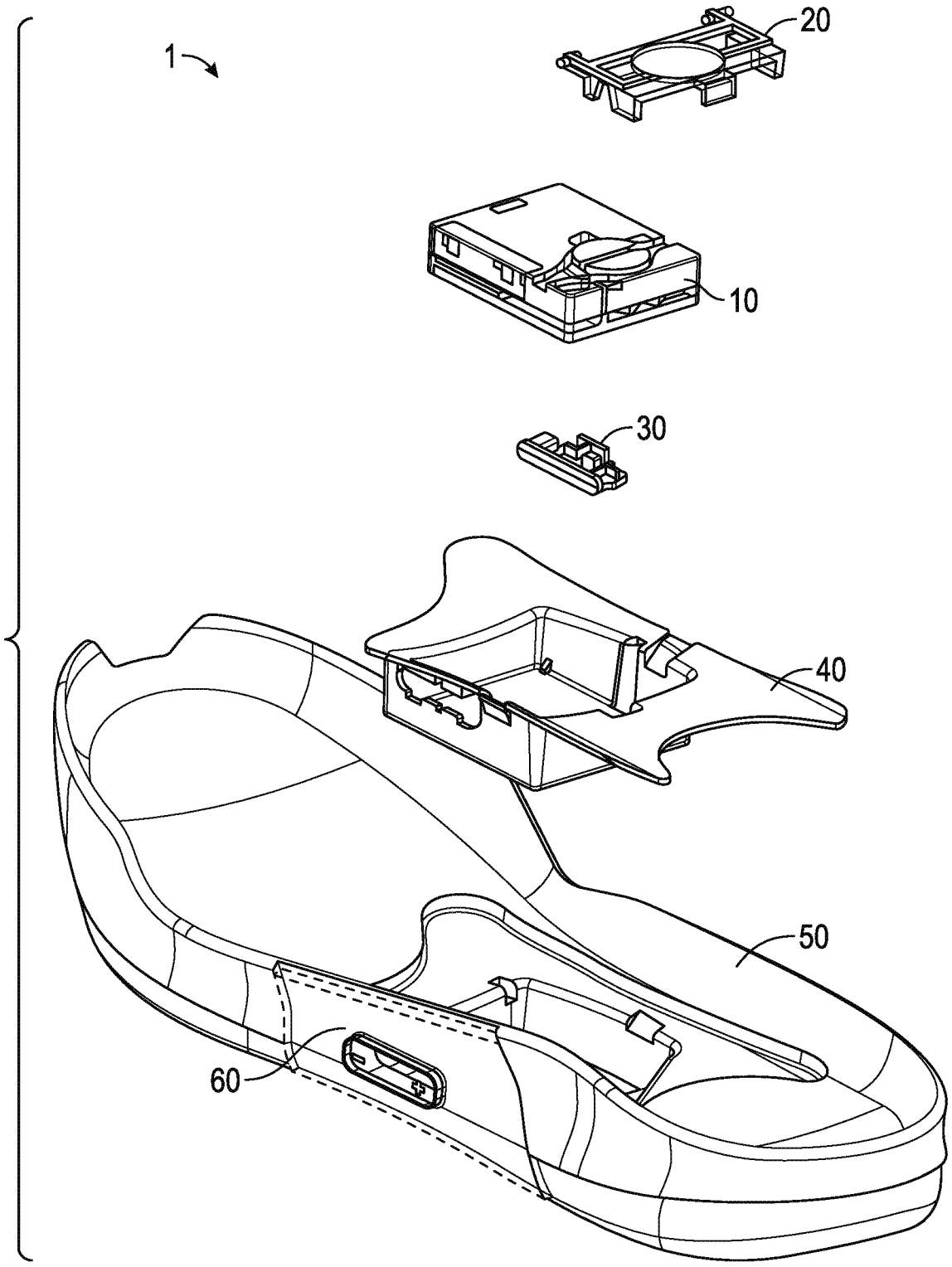
FIG. 1 is an exploded view illustration of components of a motorized lacing system, according to some example embodiments.

The headings provided herein are merely for convenience and do not necessarily affect the scope or meaning of the terms used.

DETAILED DESCRIPTION

The concept of self-tightening shoe laces was first widely popularized by the fictitious power-laced Nike® sneakers worn by Marty McFly in the movie Back to the Future II, which was released back in 1989. While Nike® has since released at least one version of power-laced sneakers similar in appearance to the movie prop version from Back to the Future II, the internal mechanical systems and surrounding footwear platform employed in these early versions do not necessarily lend themselves to mass production or daily use. Additionally, previous designs for motorized lacing systems comparatively suffered from problems such as high cost of manufacture, complexity, assembly challenges, lack of serviceability, and weak or fragile mechanical mechanisms, to highlight just a few of the many issues. The present inventors have developed a modular footwear platform to accommodate motorized and non-motorized lacing engines that solves some or all of the problems discussed above, among others. The components discussed below provide various benefits including, but not limited to: serviceable components, interchangeable automated lacing engines, robust mechanical design, reliable operation, streamlined assembly processes, and retail-level customization. Various other benefits of the components described below will be evident to persons of skill in the relevant arts.

The motorized lacing engine discussed below was developed from the ground up to provide a robust, serviceable, and inter-changeable component of an automated lacing footwear platform. The lacing engine includes unique design elements that enable retail-level final assembly into a modular footwear platform. The lacing engine design allows for the majority of the footwear assembly process to leverage known assembly technologies, with unique adaptions to standard assembly processes still being able to leverage current assembly resources.

In an example, the modular automated lacing footwear platform includes a mid-sole plate secured to the mid-sole for receiving a lacing engine. The design of the mid-sole plate allows a lacing engine to be dropped into the footwear platform as late as at a point of purchase. The mid-sole plate, and other aspects of the modular automated footwear platform, allow for different types of lacing engines to be used interchangeably. For example, the motorized lacing engine discussed below could be changed out for a human-powered lacing engine. Alternatively, a fully-automatic motorized lacing engine with foot presence sensing or other optional features could be accommodated within the standard mid-sole plate.

The automated footwear platform discussed herein can include an actuator apparatus, such as an outsole actuator interface to provide tightening control to the end user as well as visual feedback through LED lighting projected through translucent protective outsole materials. The actuator can provide tactile and visual feedback to the user to indicate status of the lacing engine or other automated footwear platform components.

This initial overview is intended to introduce the subject matter of the present patent application. It is not intended to provide an exclusive or exhaustive explanation of the various inventions disclosed in the following more detailed description.

Automated Footwear Platform

The following discusses various components of the automated footwear platform including a motorized lacing engine, a mid-sole plate, and various other components of the platform. While much of this disclosure focuses on a motorized lacing engine, many of the mechanical aspects of the discussed designs are applicable to a human-powered lacing engine or other motorized lacing engines with additional or fewer capabilities. Accordingly, the term "automated" as used in "automated footwear platform" is not intended to only cover a system that operates without user input. Rather, the term "automated footwear platform" includes various electrically powered and human-power, automatically activated and human activated mechanisms for tightening a lacing or retention system of the footwear.

FIG. 1 is an exploded view illustration of components of a motorized lacing system for footwear, according to some example embodiments. The motorized lacing system 1 illustrated in FIG. 1 includes a lacing engine 10, a lid 20, an actuator 30, a mid-sole plate 40, a mid-sole 50, and an outsole 60. FIG. 1 illustrates the basic assembly sequence of components of an automated lacing footwear platform. The motorized lacing system 1 starts with the mid-sole plate 40 being secured within the mid-sole. Next, the actuator 30 is inserted into an opening in the lateral side of the mid-sole plate opposite to interface buttons that can be embedded in the outsole 60. Next, the lacing engine 10 is dropped into the mid-sole plate 40. In an example, the lacing system 1 is inserted under a continuous loop of lacing cable and the lacing cable is aligned with a spool in the lacing engine 10 (discussed below). Finally, the lid 20 is inserted into grooves in the mid-sole plate 40, secured into a closed position, and latched into a recess in the mid-sole plate 40. The lid 20 can capture the lacing engine 10 and can assist in maintaining alignment of a lacing cable during operation.

In an example, the footwear article or the motorized lacing system 1 includes or is configured to interface with one or more sensors that can monitor or determine a foot presence characteristic. Based on information from one or more foot presence sensors, the footwear including the motorized lacing system 1 can be configured to perform various functions. For example, a foot presence sensor can be configured to provide binary information about whether a foot is present or not present in the footwear. If a binary signal from the foot presence sensor indicates that a foot is present, then the motorized lacing system 1 can be activated, such as to automatically tighten or relax (i.e., loosen) a footwear lacing cable. In an example, the footwear article includes a processor circuit that can receive or interpret signals from a foot presence sensor. The processor circuit can optionally be embedded in or with the lacing engine 10, such as in a sole of the footwear article.

Figure 2A:
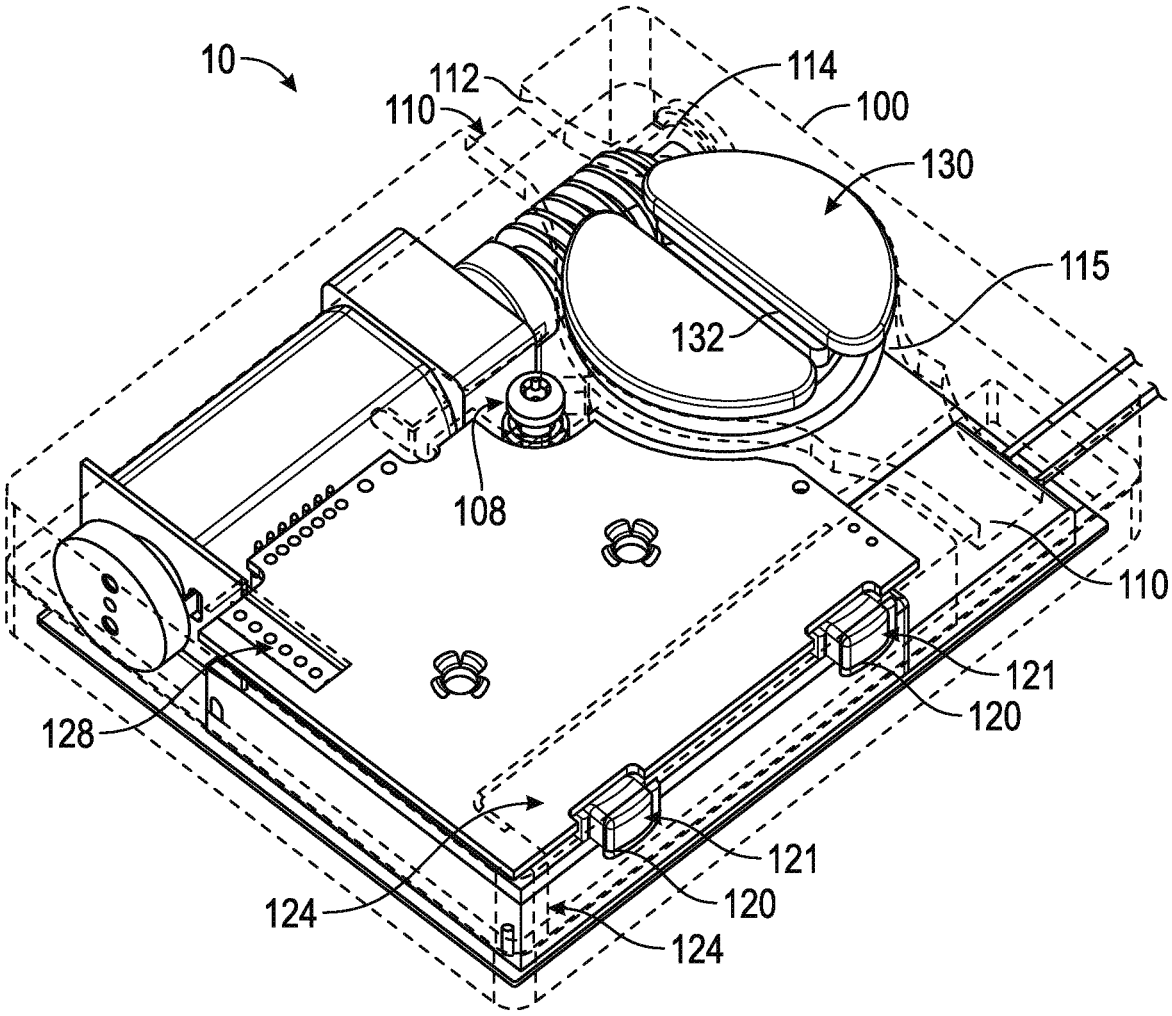
FIGS. 2A-2N are diagrams and drawings illustrating a motorized lacing engine, according to some example embodiments.
Figure 2B:
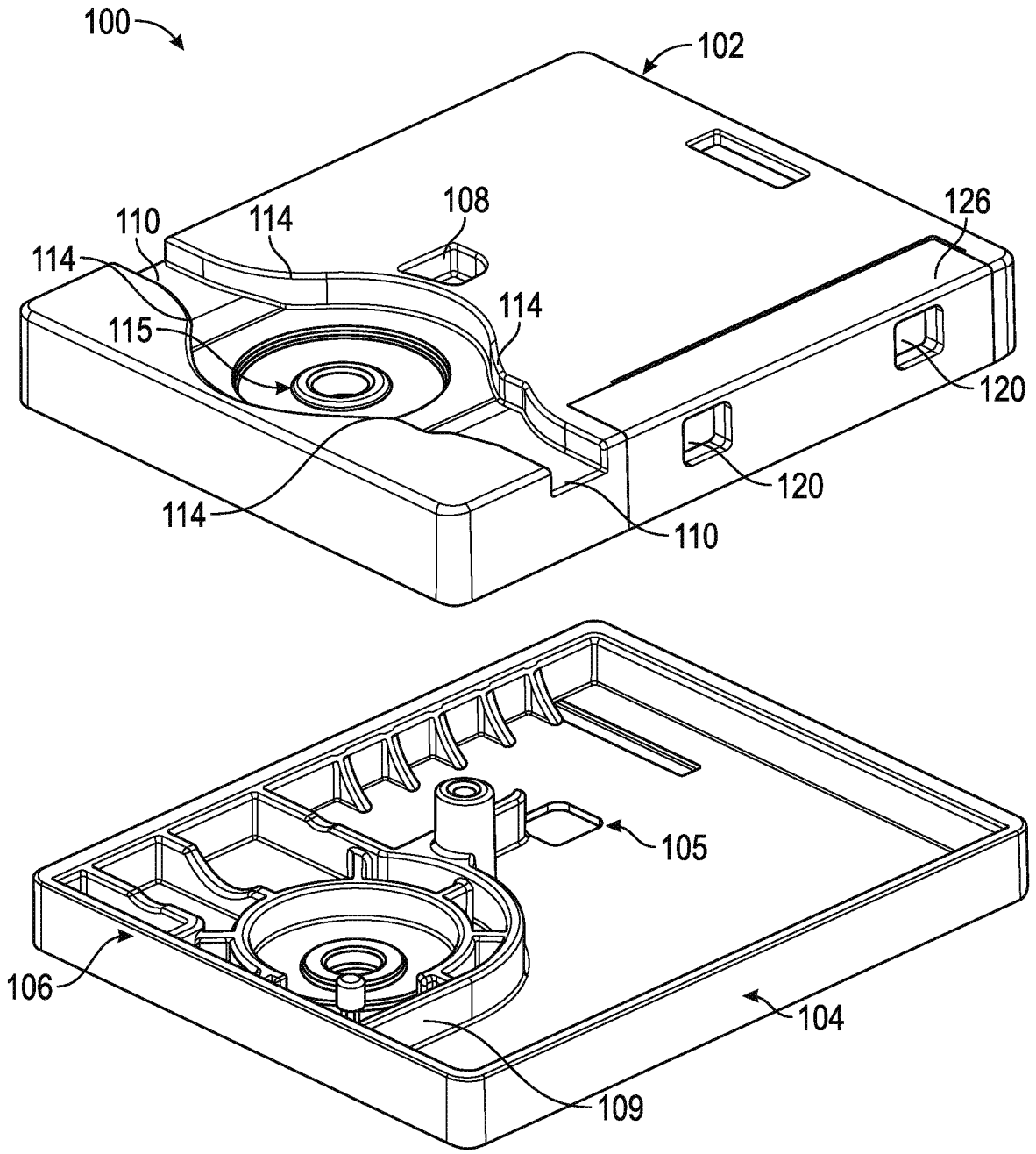
Figure 2C:
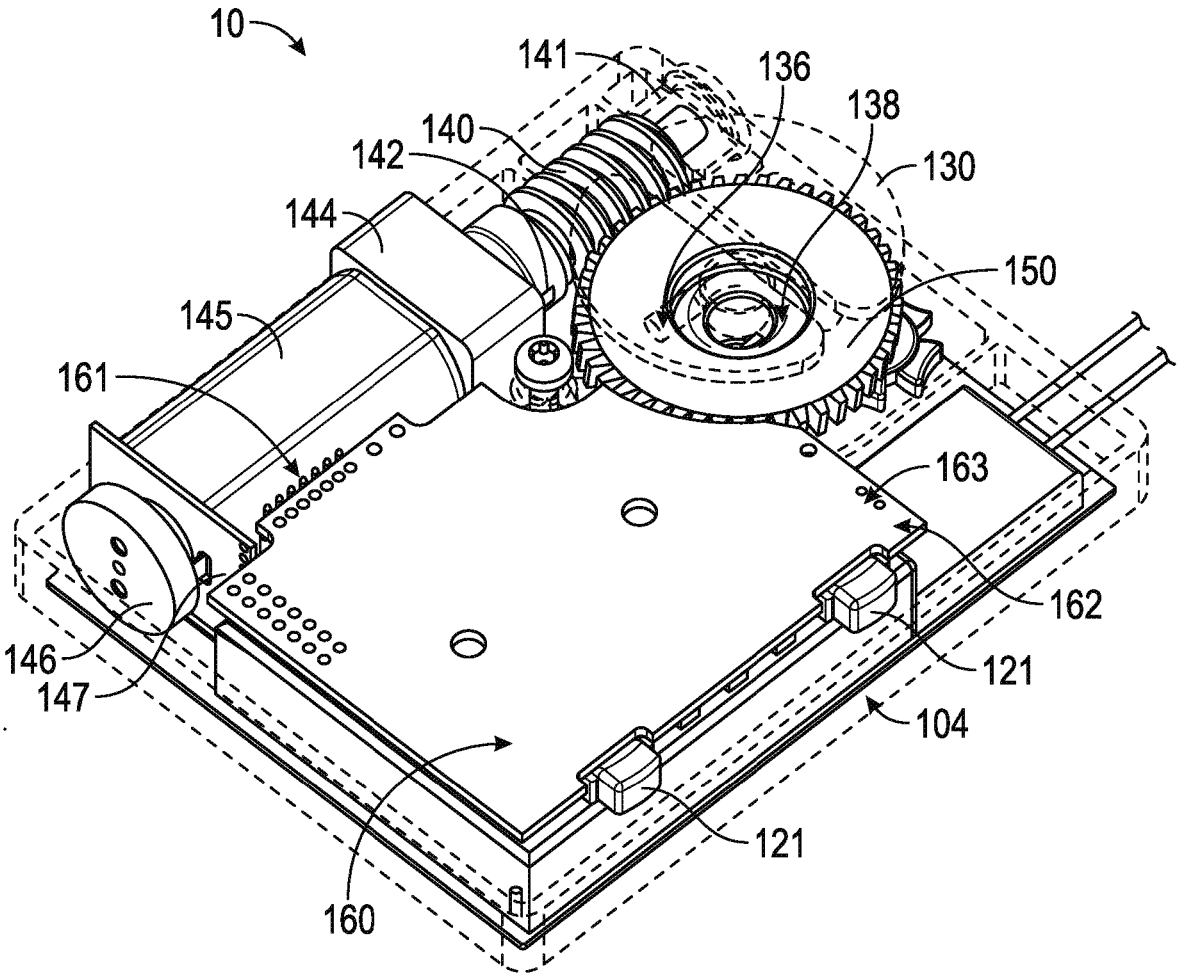
Figure 2D:
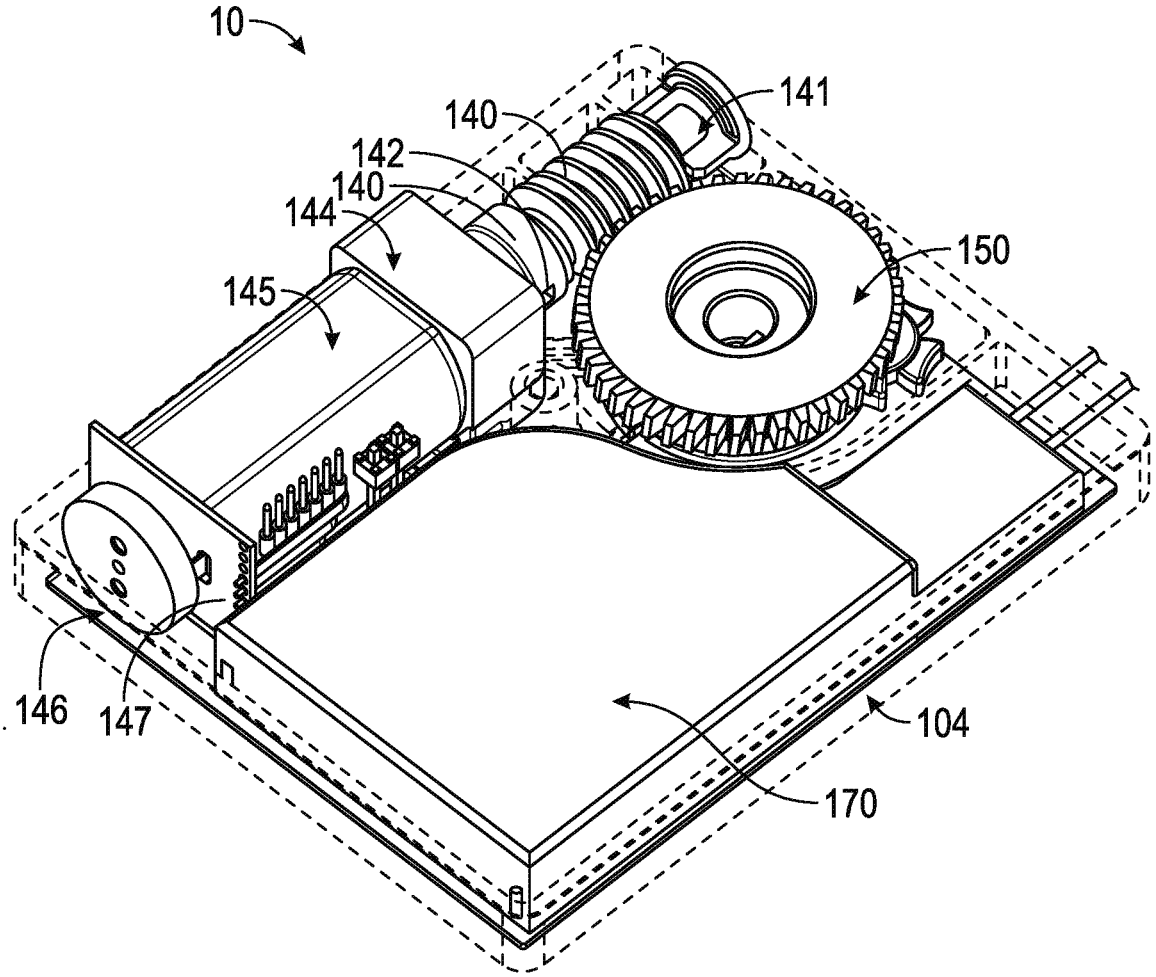
Figure 2E:
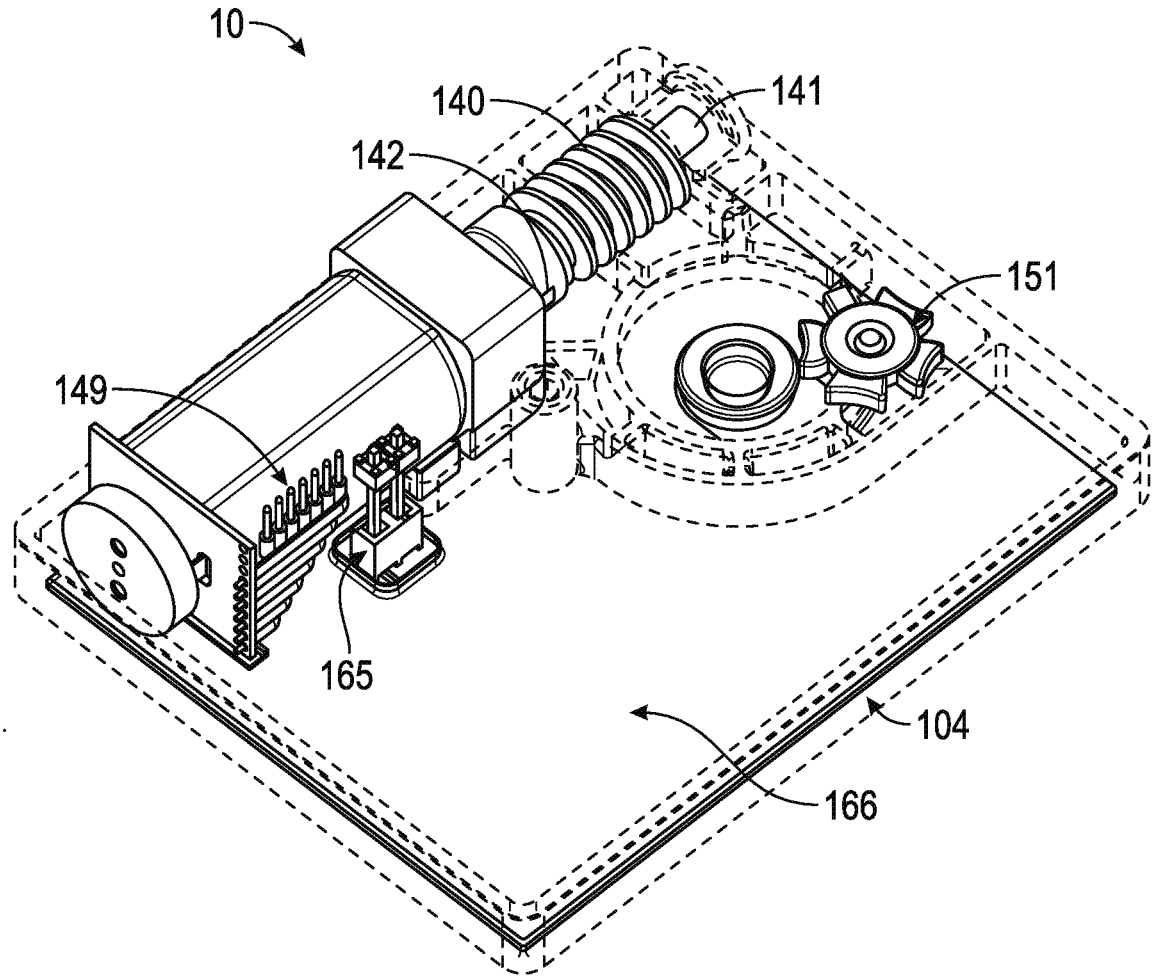
Figure 2F:
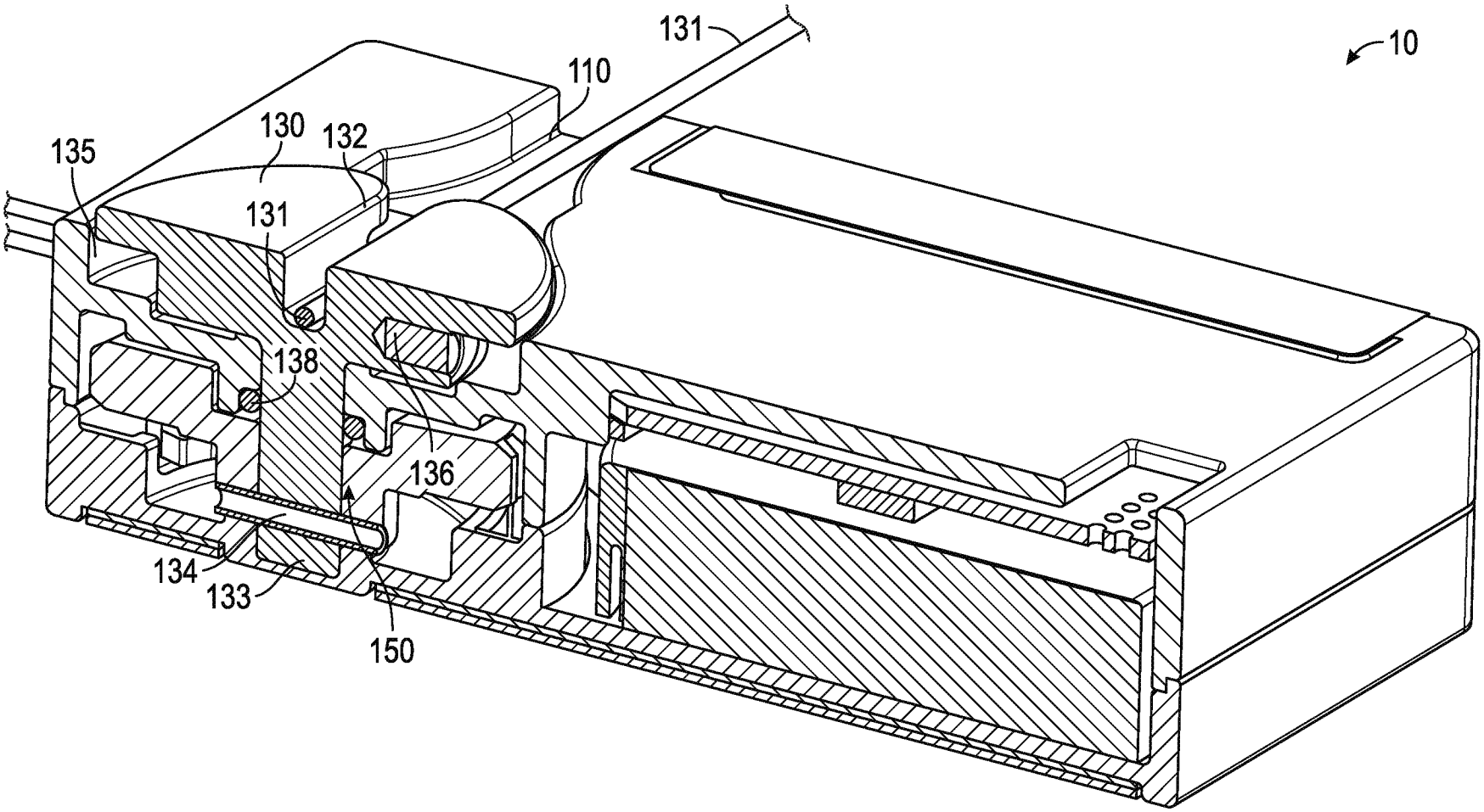
Figure 2G:
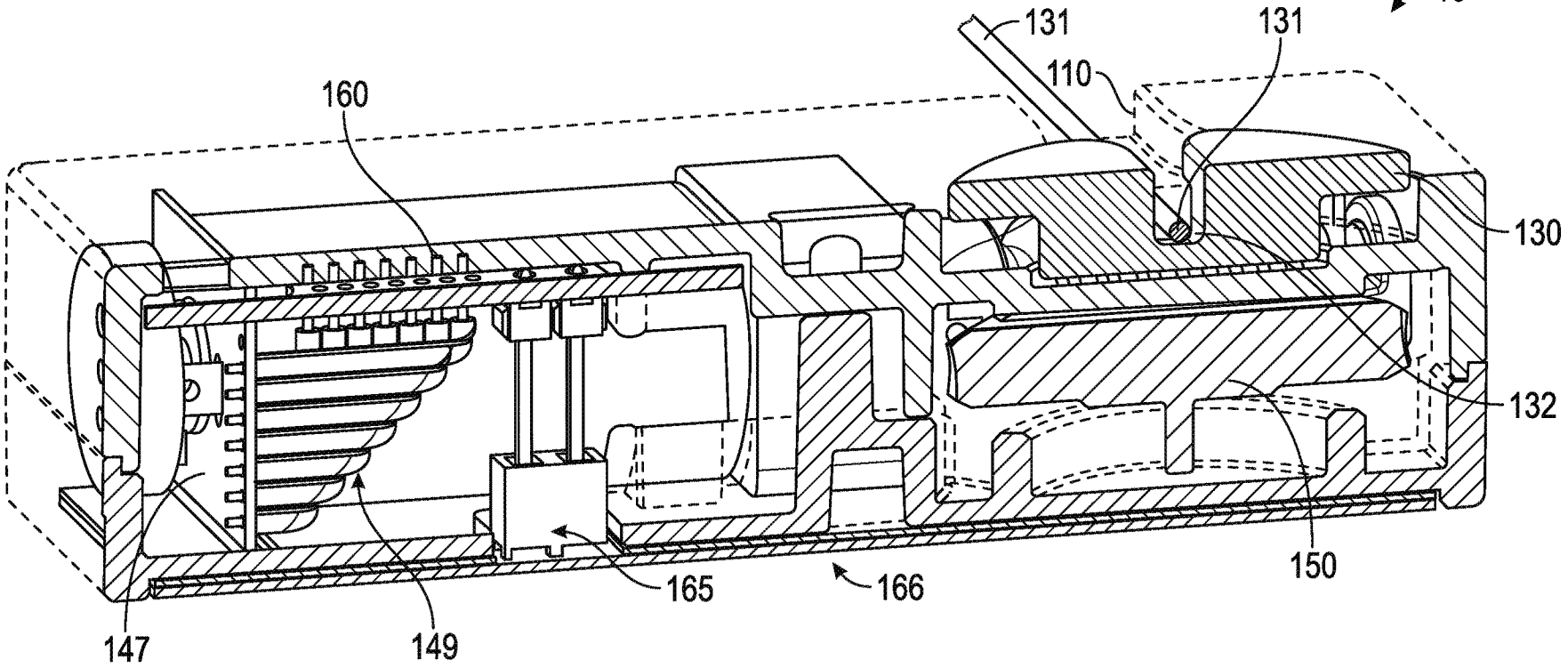
Figure 2H:
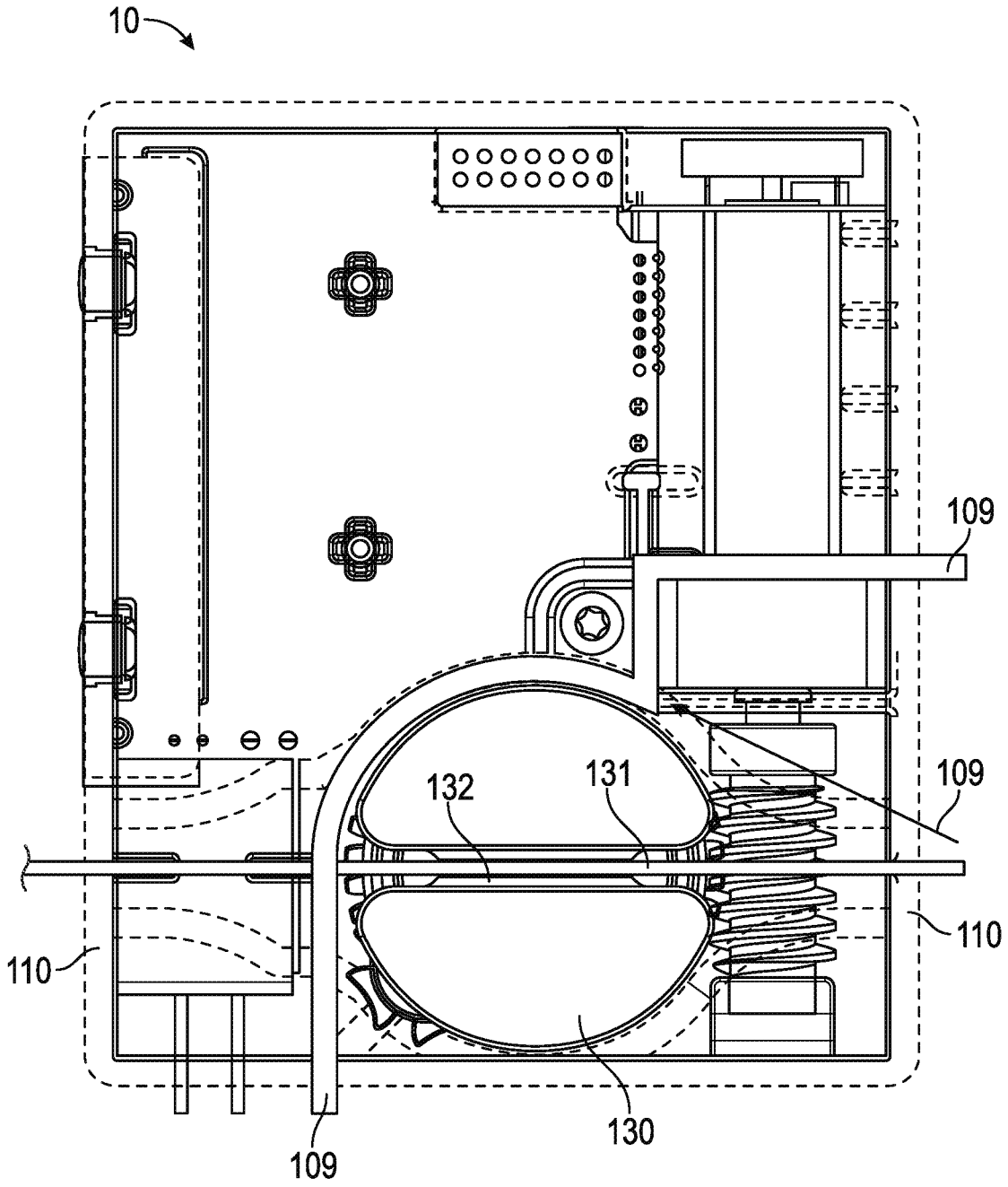
Figure 2I:
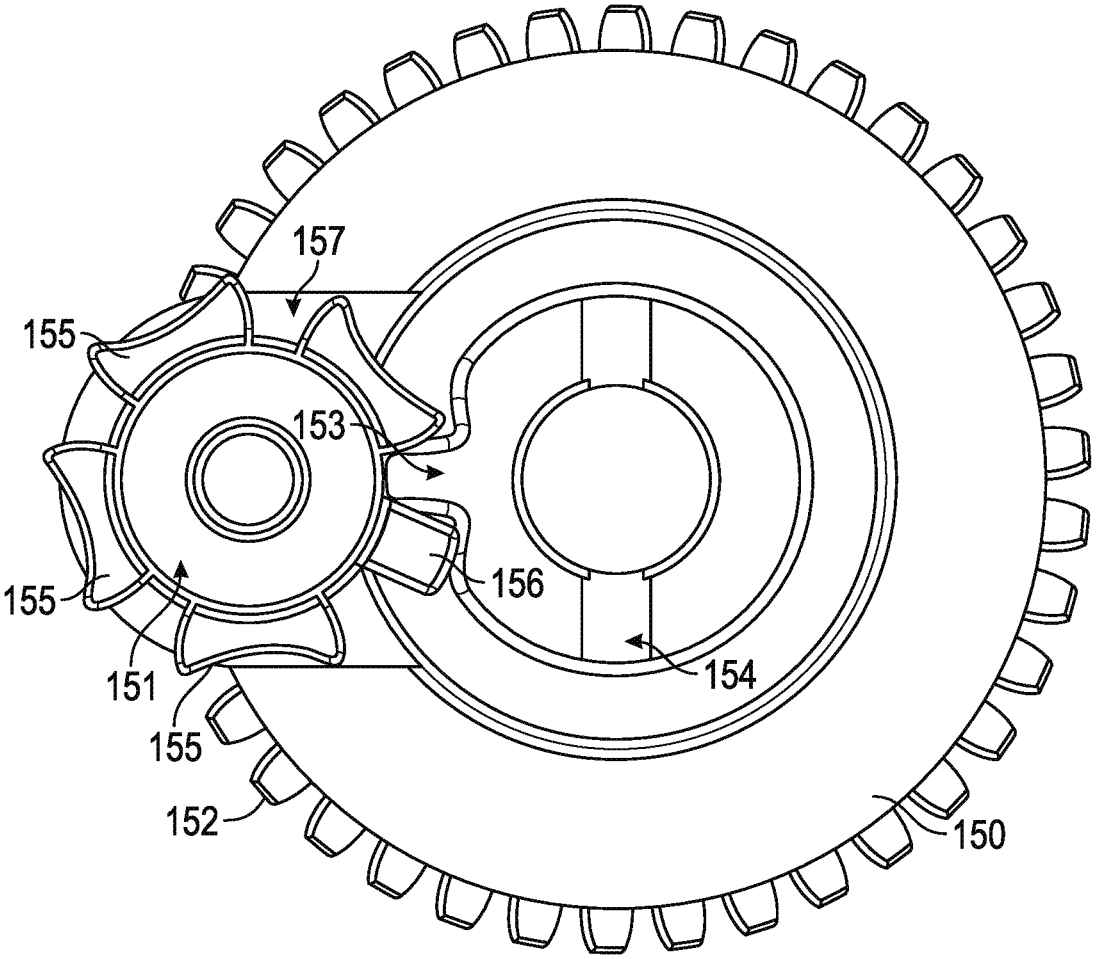
Figure 2J:
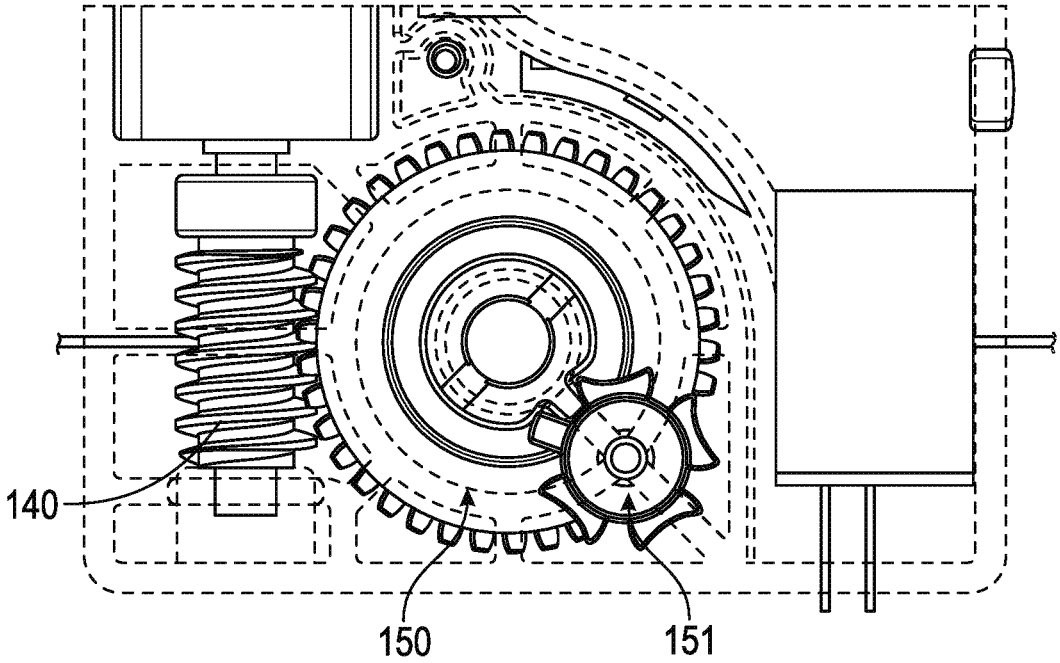
Figure 2K:
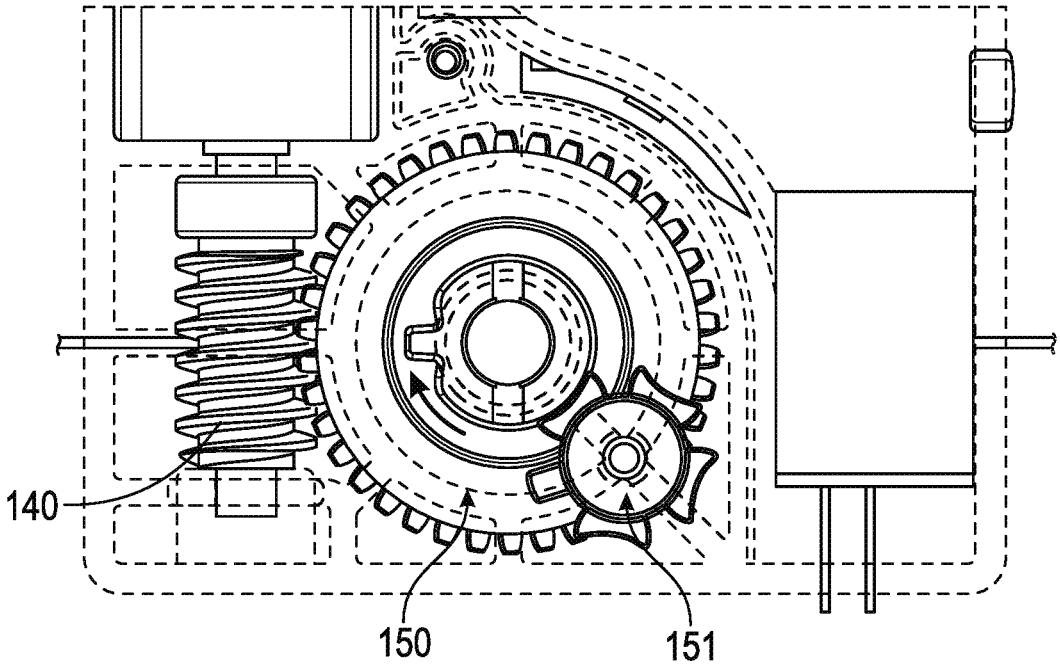
Figure 2L:
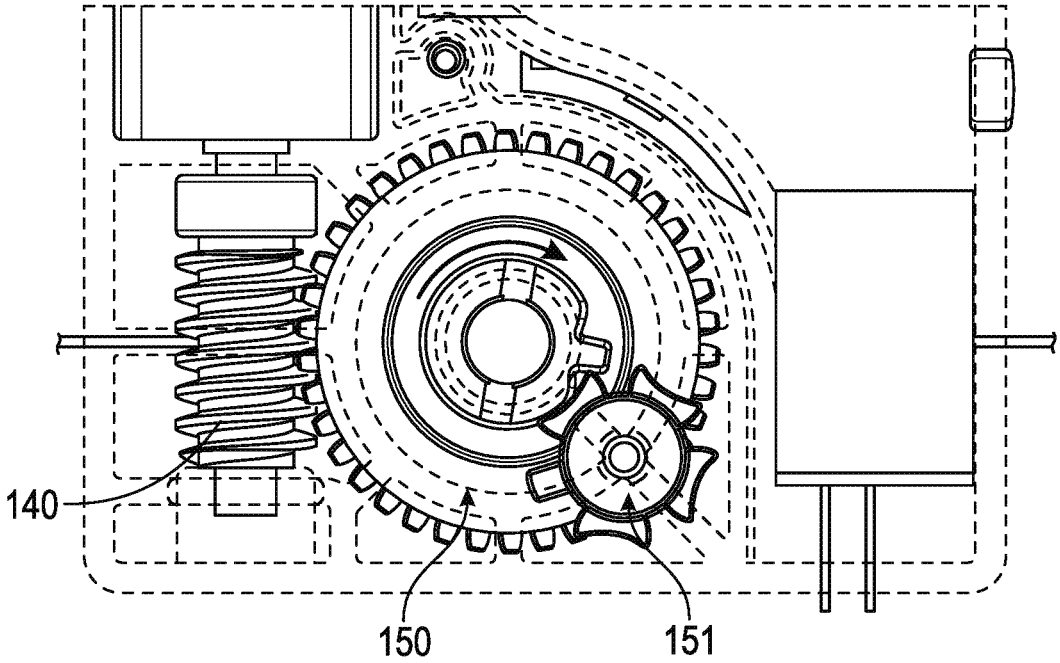
Figure 2M:
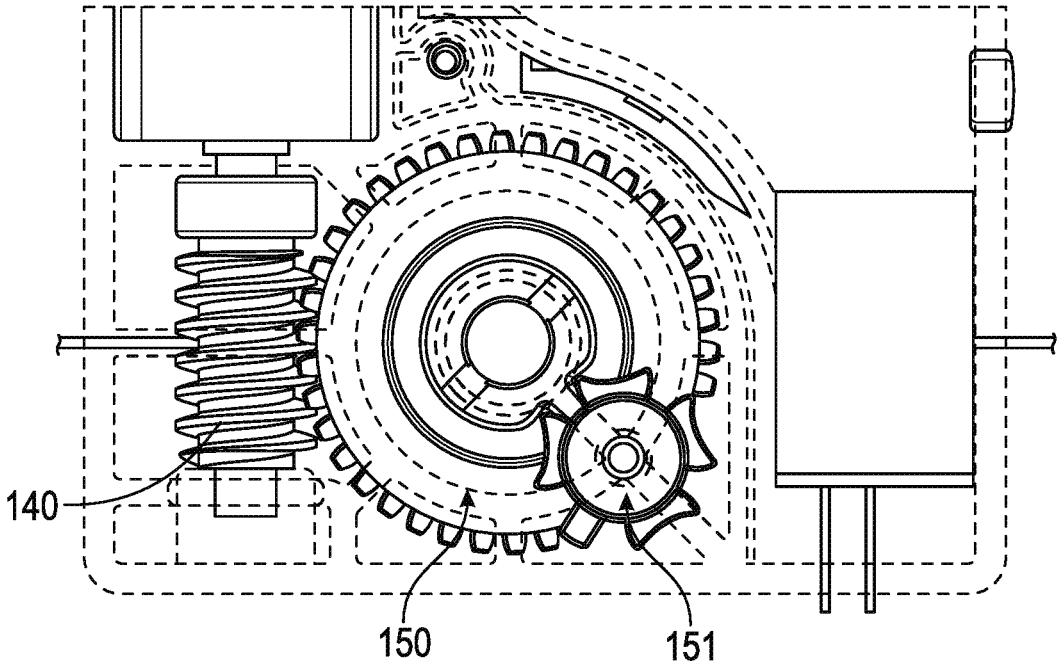
Figure 2N:
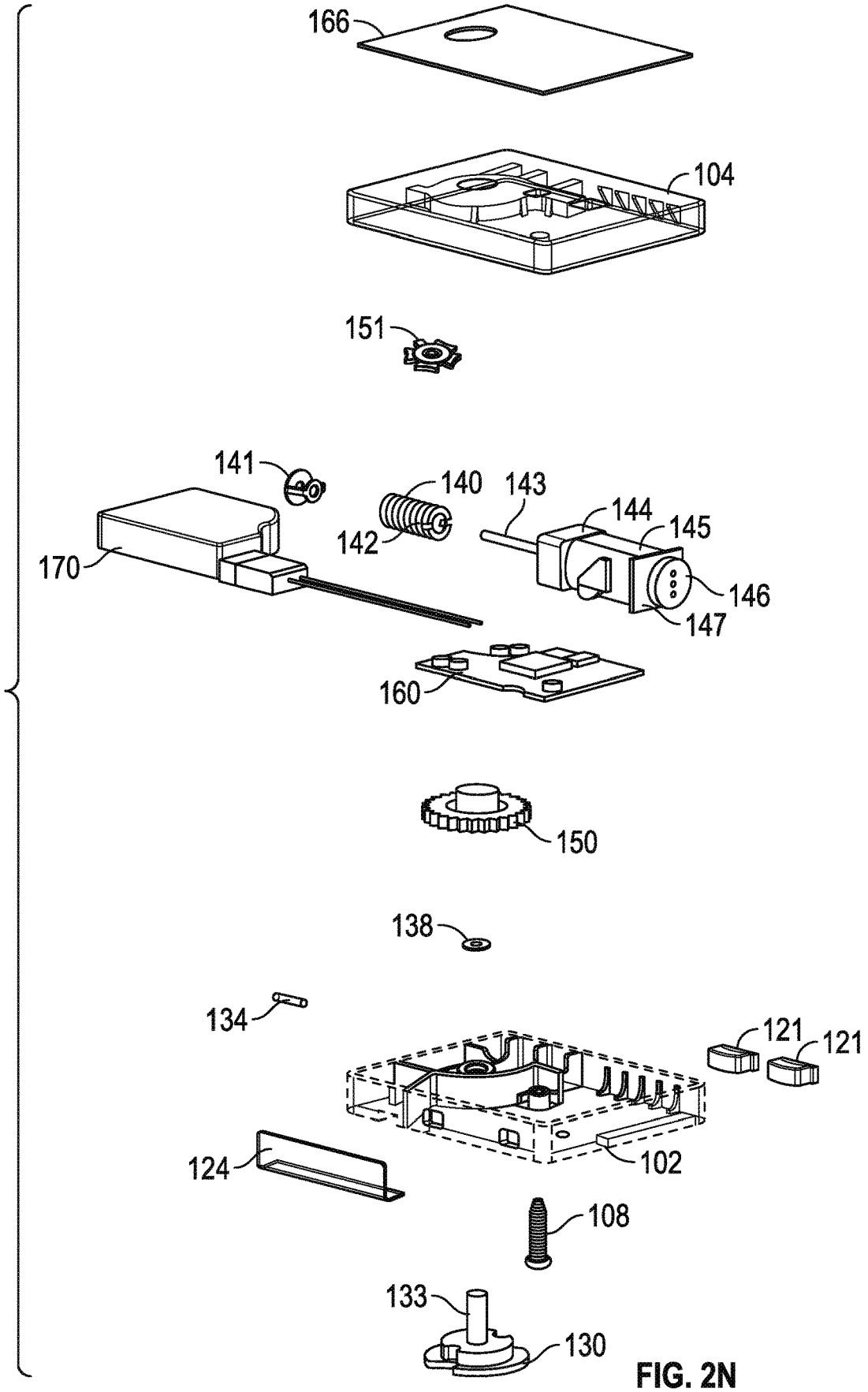

Examples of the lacing engine 10 are described in detail in reference to FIGS. 2A-2N. Examples of the actuator 30 are described in detail in reference to FIGS. 3A-3D. Examples of the mid-sole plate 40 are described in detail in reference to FIGS. 4A-4D. Various additional details of the motorized lacing system 1 are discussed throughout the remainder of the description.

FIGS. 2A-2N are diagrams and drawings illustrating a motorized lacing engine, according to some example embodiments. FIG. 2A introduces various external features of an example lacing engine 10, including a housing structure 100, case screw 108, lace channel 110 (also referred to as lace guide relief 110), lace channel wall 112, lace channel transition 114, spool recess 115, button openings 120, buttons 121, button membrane seal 124, programming header 128, spool 130, and lace grove 132. Additional details of the housing structure 100 are discussed below in reference to FIG. 2B.

In an example, the lacing engine 10 is held together by one or more screws, such as the case screw 108. The case screw 108 is positioned near the primary drive mechanisms to enhance structural integrity of the lacing engine 10. The case screw 108 also functions to assist the assembly process, such as holding the case together for ultra-sonic welding of exterior seams.

In this example, the lacing engine 10 includes a lace channel 110 to receive a lace or lace cable once assembled into the automated footwear platform. The lace channel 110 can include a lace channel wall 112. The lace channel wall 112 can include chamfered edges to provide a smooth guiding surface for a lace cable to run in during operation. Part of the smooth guiding surface of the lace channel 110 can include a channel transition 114, which is a widened portion of the lace channel 110 leading into the spool recess 115. The spool recess 115 transitions from the channel transition 114 into generally circular sections that conform closely to the profile of the spool 130. The spool recess 115 assists in retaining the spooled lace cable, as well as in retaining position of the spool 130. However, other aspects of the design provide primary retention of the spool 130. In this example, the spool 130 is shaped similarly to half of a yo-yo with a lace grove 132 running through a flat top surface and a spool shaft 133 (not shown in FIG. 2A) extending inferiorly from the opposite side. The spool 130 is described in further detail below in reference of additional figures.

The lateral side of the lacing engine 10 includes button openings 120 that enable buttons 121 for activation of the mechanism to extend through the housing structure 100. The buttons 121 provide an external interface for activation of switches 122, illustrated in additional figures discussed below. In some examples, the housing structure 100 includes button membrane seal 124 to provide protection from dirt and water. In this example, the button membrane seal 124 is up to a few mils (thousandth of an inch) thick clear plastic (or similar material) adhered from a superior surface of the housing structure 100 over a corner and down a lateral side. In another example, the button membrane seal 124 is a 2 mil thick vinyl adhesive backed membrane covering the buttons 121 and button openings 120.

FIG. 2B is an illustration of housing structure 100 including top section 102 and bottom section 104. In this example, the top section 102 includes features such as the case screw 108, lace channel 110, lace channel transition 114, spool recess 115, button openings 120, and button seal recess 126. The button seal recess 126 is a portion of the top section 102 relieved to provide an inset for the button membrane seal 124. In this example, the button seal recess 126 is a couple mil recessed portion on the lateral side of the superior surface of the top section 104 transitioning over a portion of the lateral edge of the superior surface and down the length of a portion of the lateral side of the top section 104.

In this example, the bottom section 104 includes features such as wireless charger access 105, joint 106, and grease isolation wall 109. Also illustrated, but not specifically identified, is the case screw base for receiving case screw 108 as well as various features within the grease isolation wall 109 for holding portions of a drive mechanism. The grease isolation wall 109 is designed to retain grease or similar compounds surrounding the drive mechanism away from the electrical components of the lacing engine 10 including the gear motor and enclosed gear box. In this example, the worm gear 150 and worm drive 140 are contained within the grease isolation wall 109, while other drive components such as gear box 144 and gear motor 145 are outside the grease isolation wall 109. Positioning of the various components can be understood through a comparison of FIG. 2B with FIG. 2C, for example.

FIG. 2C is an illustration of various internal components of lacing engine 10, according to example embodiments. In this example, the lacing engine further includes spool magnet 136, O-ring seal 138, worm drive 140, bushing 141, worm drive key 142, gear box 144, gear motor 145, motor encoder 146, motor circuit board 147, worm gear 150, circuit board 160, motor header 161, battery connection 162, and wired charging header 163. The spool magnet 136 assists in tracking movement of the spool 130 though detection by a magnetometer (not shown in FIG. 2C). The o-ring seal 138 functions to seal out dirt and moisture that could migrate into the lacing engine 10 around the spool shaft 133.

In this example, major drive components of the lacing engine 10 include worm drive 140, worm gear 150, gear motor 145 and gear box 144. The worm gear 150 is designed to inhibit back driving of worm drive 140 and gear motor 145, which means the major input forces coming in from the lacing cable via the spool 130 are resolved on the comparatively large worm gear and worm drive teeth. This arrangement protects the gear box 144 from needing to include gears of sufficient strength to withstand both the dynamic loading from active use of the footwear platform or tightening loading from tightening the lacing system. The worm drive 140 includes additional features to assist in protecting the more fragile portions of the drive system, such as the worm drive key 142. In this example, the worm drive key 142 is a radial slot in the motor end of the worm drive 140 that interfaces with a pin through the drive shaft coming out of the gear box 144. This arrangement prevents the worm drive 140 from imparting any axial forces on the gear box 144 or gear motor 145 by allowing the worm drive 140 to move freely in an axial direction (away from the gear box 144) transferring those axial loads onto bushing 141 and the housing structure 100.

FIG. 2D is an illustration depicting additional internal components of the lacing engine 10. In this example, the lacing engine 10 includes drive components such as worm drive 140, bushing 141, gear box 144, gear motor 145, motor encoder 146, motor circuit board 147 and worm gear 150. FIG. 2D adds illustration of battery 170 as well as a better view of some of the drive components discussed above.

FIG. 2E is another illustration depicting internal components of the lacing engine 10. In FIG. 2E the worm gear 150 is removed to better illustrate the indexing wheel 151 (also referred to as the Geneva wheel 151). The indexing wheel 151, as described in further detail below, provides a mechanism to home the drive mechanism in case of electrical or mechanical failure and loss of position. In this example, the lacing engine 10 also includes a wireless charging interconnect 165 and a wireless charging coil 166, which are located inferior to the battery 170 (which is not shown in this figure). In this example, the wireless charging coil 166 is mounted on an external inferior surface of the bottom section 104 of the lacing engine 10.

FIG. 2F is a cross-section illustration of the lacing engine 10, according to example embodiments. FIG. 2F assists in illustrating the structure of the spool 130 as well as how the lace grove 132 and lace channel 110 interface with lace cable 131. As shown in this example, lace 131 runs continuously through the lace channel 110 and into the lace grove 132 of the spool 130. The cross-section illustration also depicts lace recess 135 and spool mid-section, which are where the lace 131 will build up as it is taken up by rotation of the spool 130. The spool mid-section 137 is a circular reduced diameter section disposed inferiorly to the superior surface of the spool 130. The lace recess 135 is formed by a superior portion of the spool 130 that extends radially to substantially fill the spool recess 115, the sides and floor of the spool recess 115, and the spool mid-section 137. In some examples, the superior portion of the spool 130 can extend beyond the spool recess 115. In other examples, the spool 130 fits entirely within the spool recess 115, with the superior radial portion extending to the sidewalls of the spool recess 115, but allowing the spool 130 to freely rotation with the spool recess 115. The lace 131 is captured by the lace groove 132 as it runs across the lacing engine 10, so that when the spool 130 is turned, the lace 131 is rotated onto a body of the spool 130 within the lace recess 135.

As illustrated by the cross-section of lacing engine 10, the spool 130 includes a spool shaft 133 that couples with worm gear 150 after running through an O-ring 138. In this example, the spool shaft 133 is coupled to the worm gear via keyed connection pin 134. In some examples, the keyed connection pin 134 only extends from the spool shaft 133 in one axial direction, and is contacted by a key on the worm gear in such a way as to allow for an almost complete revolution of the worm gear 150 before the keyed connection pin 134 is contacted when the direction of worm gear 150 is reversed. A clutch system could also be implemented to couple the spool 130 to the worm gear 150. In such an example, the clutch mechanism could be deactivated to allow the spool 130 to run free upon de-lacing (loosening). In the example of the keyed connection pin 134 only extending is one axial direction from the spool shaft 133, the spool is allowed to move freely upon initial activation of a de-lacing process, while the worm gear 150 is driven backward. Allowing the spool 130 to move freely during the initial portion of a de-lacing process assists in preventing tangles in the lace 131 as it provides time for the user to begin loosening the footwear, which in turn will tension the lace 131 in the loosening direction prior to being driven by the worm gear 150.

FIG. 2G is another cross-section illustration of the lacing engine 10, according to example embodiments. FIG. 2G illustrates a more medial cross-section of the lacing engine 10, as compared to FIG. 2F, which illustrates additional components such as circuit board 160, wireless charging interconnect 165, and wireless charging coil 166. FIG. 2G is also used to depict additional detail surround the spool 130 and lace 131 interface.

FIG. 2H is a top view of the lacing engine 10, according to example embodiments. FIG. 2H emphasizes the grease isolation wall 109 and illustrates how the grease isolation wall 109 surrounds certain portions of the drive mechanism, including spool 130, worm gear 150, worm drive 140, and gear box 145. In certain examples, the grease isolation wall 109 separates worm drive 140 from gear box 145. FIG. 2H also provides a top view of the interface between spool 130 and lace cable 131, with the lace cable 131 running in a medial-lateral direction through lace groove 132 in spool 130.

FIG. 2I is a top view illustration of the worm gear 150 and index wheel 151 portions of lacing engine 10, according to example embodiments. The index wheel 151 is a variation on the well-known Geneva wheel used in watchmaking and film projectors. A typical Geneva wheel or drive mechanism provides a method of translating continuous rotational movement into intermittent motion, such as is needed in a film projector or to make the second hand of a watch move intermittently. Watchmakers used a different type of Geneva wheel to prevent over-winding of a mechanical watch spring, but using a Geneva wheel with a missing slot (e.g., one of the Geneva slots 157 would be missing). The missing slot would prevent further indexing of the Geneva wheel, which was responsible for winding the spring and prevents over-winding. In the illustrated example, the lacing engine includes a variation on the Geneva wheel, indexing wheel 151, which includes a small stop tooth 156 that acts as a stopping mechanism in a homing operation. As illustrated in FIGS. 2J-2M, the standard Geneva teeth 155 simply index for each rotation of the worm gear 150 when the index tooth 152 engages the Geneva slot 157 next to one of the Geneva teeth 155. However, when the index tooth 152 engages the Geneva slot 157 next to the stop tooth 156 a larger force is generated, which can be used to stall the drive mechanism in a homing operation. The stop tooth 156 can be used to create a known location of the mechanism for homing in case of loss of other positioning information, such as the motor encoder 146.

FIG. 2J-2M are illustrations of the worm gear 150 and index wheel 151 moving through an index operation, according to example embodiments. As discussed above, these figures illustrate what happens during a single full revolution of the worm gear 150 starting with FIG. 2J though FIG. 2M. In FIG. 2J, the index tooth 153 of the worm gear 150 is engaged in the Geneva slot 157 between a first Geneva tooth 155*a* of the Geneva teeth 155 and the stop tooth 156. FIG. 2K illustrates the index wheel 151 in a first index position, which is maintained as the index tooth 153 starts its revolution with the worm gear 150. In FIG. 2L, the index tooth 153 begins to engage the Geneva slot 157 on the opposite side of the first Geneva tooth 155*a*. Finally, in FIG. 2M the index tooth 153 is fully engaged within a Geneva lot 157 between the first Geneva tooth 155*a* and a second Geneva tooth 155*b*. The process shown in FIGS. 2J-2M continues with each revolution of the worm gear 150 until the index tooth 153 engages the stop tooth 156. As discussed above, wen the index tooth 153 engages the stop tooth 156, the increased forces can stall the drive mechanism.

FIG. 2N is an exploded view of lacing engine 10, according to example embodiments. The exploded view of the lacing engine 10 provides an illustration of how all the various components fit together. FIG. 2N shows the lacing engine 10 upside down, with the bottom section 104 at the top of the page and the top section 102 near the bottom. In this example, the wireless charging coil 166 is shown as being adhered to the outside (bottom) of the bottom section 104. The exploded view also provide a good illustration of how the worm drive 140 is assembled with the bushing 141, drive shaft 143, gear box 144 and gear motor 145. The illustration does not include a drive shaft pin that is received within the worm drive key 142 on a first end of the worm drive 140. As discussed above, the worm drive 140 slides over the drive shaft 143 to engage a drive shaft pin in the worm drive key 142, which is essentially a slot running transverse to the drive shaft 143 in a first end of the worm drive 140.

Figure 3A:
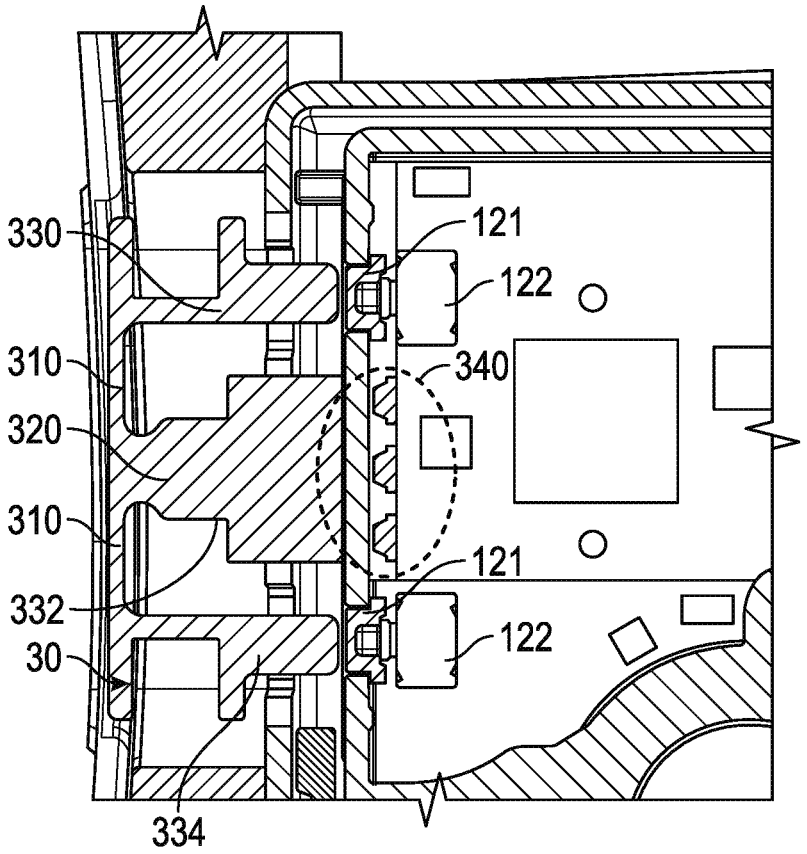
FIGS. 3A-3D are diagrams and drawings illustrating an actuator for interfacing with a motorized lacing engine, according to some example embodiments.

FIGS. 3A-3D are diagrams and drawings illustrating an actuator 30 for interfacing with a motorized lacing engine, according to an example embodiment. In this example, the actuator 30 includes features such as bridge 310, light pipe 320, posterior arm 330, central arm 332, and anterior arm 334. FIG. 3A also illustrates related features of lacing engine 10, such as LEDs 340 (also referenced as LED 340), buttons 121 and switches 122. In this example, the posterior arm 330 and anterior arm 334 each can separately activate one of the switches 122 through buttons 121. The actuator 30 is also designed to enable activation of both switches 122 simultaneously, for things like reset or other functions. The primary function of the actuator 30 is to provide tightening and loosening commands to the lacing engine 10. The actuator 30 also includes a light pipe 320 that directs light from LEDs 340 out to the external portion of the footwear platform (e.g., outsole 60). The light pipe 320 is structured to disperse light from multiple individual LED sources evening across the face of actuator 30.

In this example, the arms of the actuator 30, posterior arm 330 and anterior arm 334, include flanges to prevent over activation of switches 122 providing a measure of safety against impacts against the side of the footwear platform. The large central arm 332 is also designed to carry impact loads against the side of the lacing engine 10, instead of allowing transmission of these loads against the buttons 121.

Figure 3B:
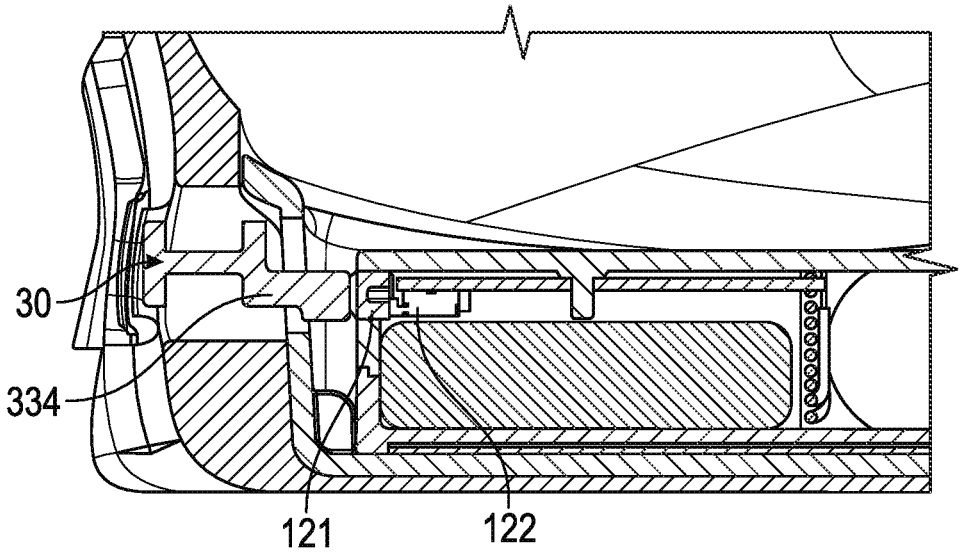
Figure 3C:
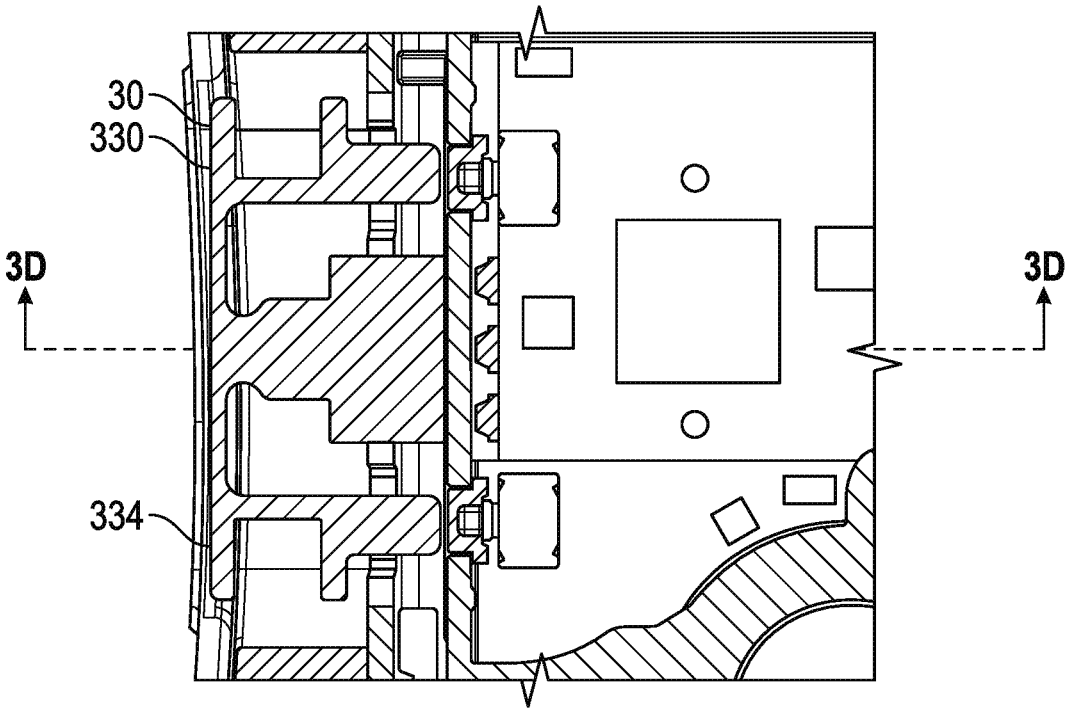
Figure 3D:
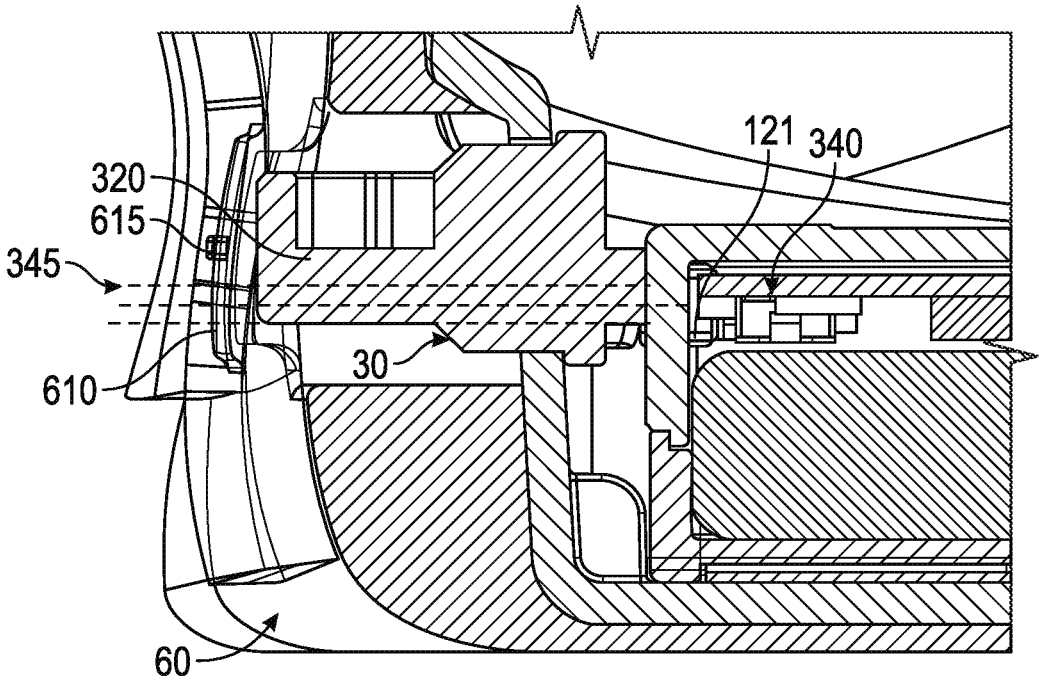

FIG. 3B provides a side view of the actuator 30, which further illustrates an example structure of anterior arm 334 and engagement with button 121. FIG. 3C is an additional top view of actuator 30 illustrating activation paths through posterior arm 330 and anterior arm 334. FIG. 3C also depicts section line A-A, which corresponds to the cross-section illustrated in FIG. 3D. In FIG. 3D, the actuator 30 is illustrated in cross-section with transmitted light 345 shown in dotted lines. The light pipe 320 provides a transmission medium for transmitted light 345 from LEDs 340. FIG. 3D also illustrates aspects of outsole 60, such as actuator cover 610 and raised actuator interface 615.

FIGS. 4A-4D are diagrams and drawings illustrating a mid-sole plate for holding lacing engine 10, according to some example embodiments. In this example, the mid-sole plate 40 includes features such as lacing engine cavity 410, medial lace guide 420, lateral lace guide 421, lid slot 430, anterior flange 440, posterior flange 450, a superior surface 460, an inferior surface 470, and an actuator cutout 480. The lacing engine cavity 410 is designed to receive lacing engine 10. In this example, the lacing engine cavity 410 retains the lacing engine 10 is lateral and anterior/posterior directions, but does not include any built in feature to lock the lacing engine 10 in to the pocket. Optionally, the lacing engine cavity 410 can include detents, tabs, or similar mechanical features along one or more sidewalls that could positively retain the lacing engine 10 within the lacing engine cavity 410.

The medial lace guide 420 and lateral lace guide 421 assist in guiding lace cable into the lace engine pocket 410 and over lacing engine 10 (when present). The medial/lateral lace guides 420, 421 can include chamfered edges and inferiorly slated ramps to assist in guiding the lace cable into the desired position over the lacing engine 10. In this example, the medial/lateral lace guides 420, 421 include openings in the sides of the mid-sole plate 40 that are many times wider than the typical lacing cable diameter, in other examples the openings for the medial/lateral lace guides 420, 421 may only be a couple times wider than the lacing cable diameter.

In this example, the mid-sole plate 40 includes a sculpted or contoured anterior flange 440 that extends much further on the medial side of the mid-sole plate 40. The example anterior flange 440 is designed to provide additional support under the arch of the footwear platform. However, in other examples the anterior flange 440 may be less pronounced in on the medial side. In this example, the posterior flange 450 also includes a particular contour with extended portions on both the medial and lateral sides. The illustrated posterior flange 450 shape provides enhanced lateral stability for the lacing engine 10.

Figure 4A:
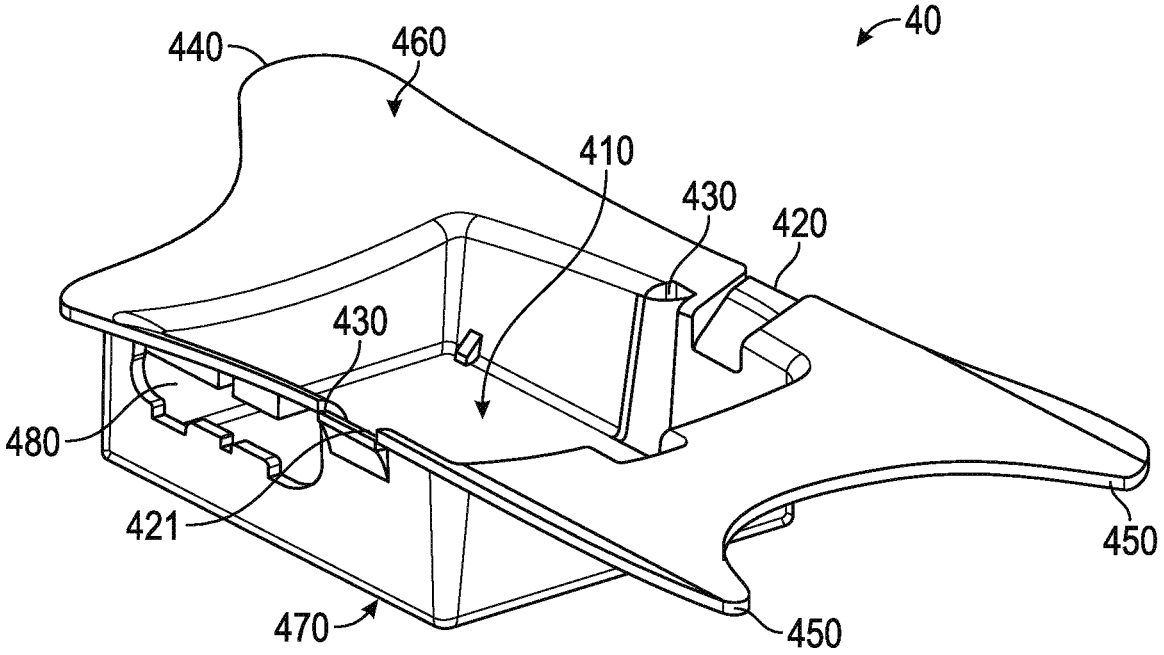
FIGS. 4A-4D are diagrams and drawings illustrating a mid-sole plate for holding a lacing engine, according to some example embodiments.
Figure 4B:
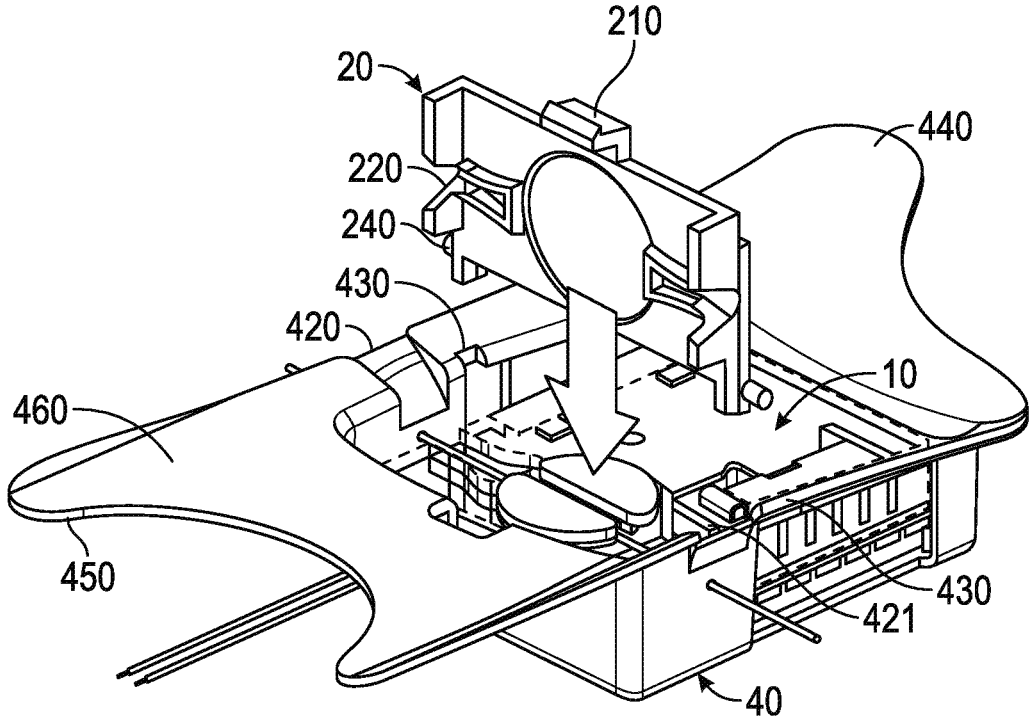
Figure 4C:
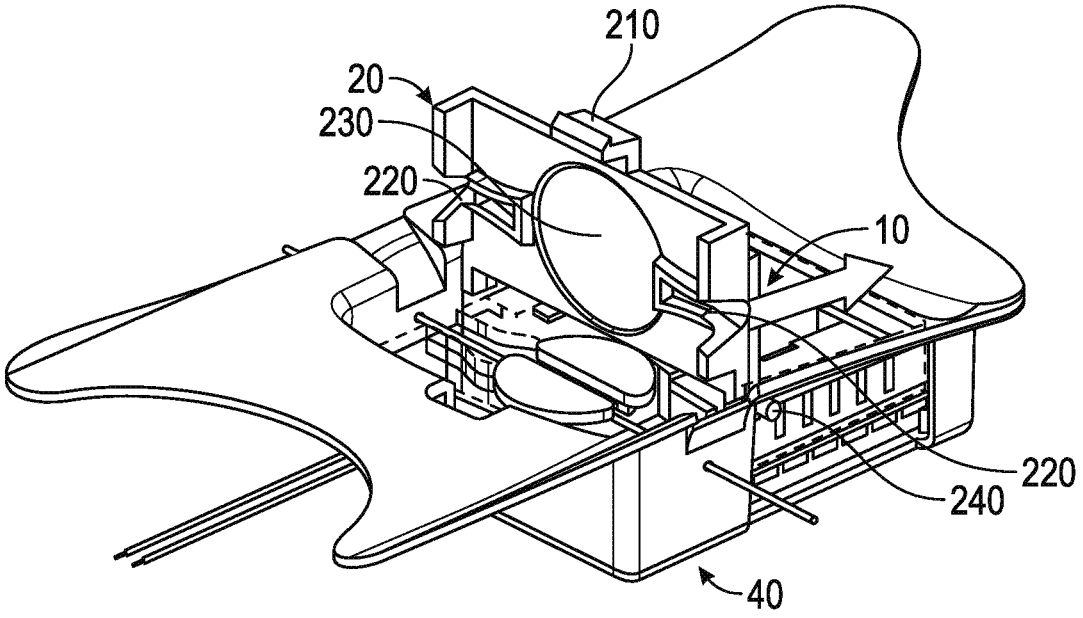
Figure 4D:
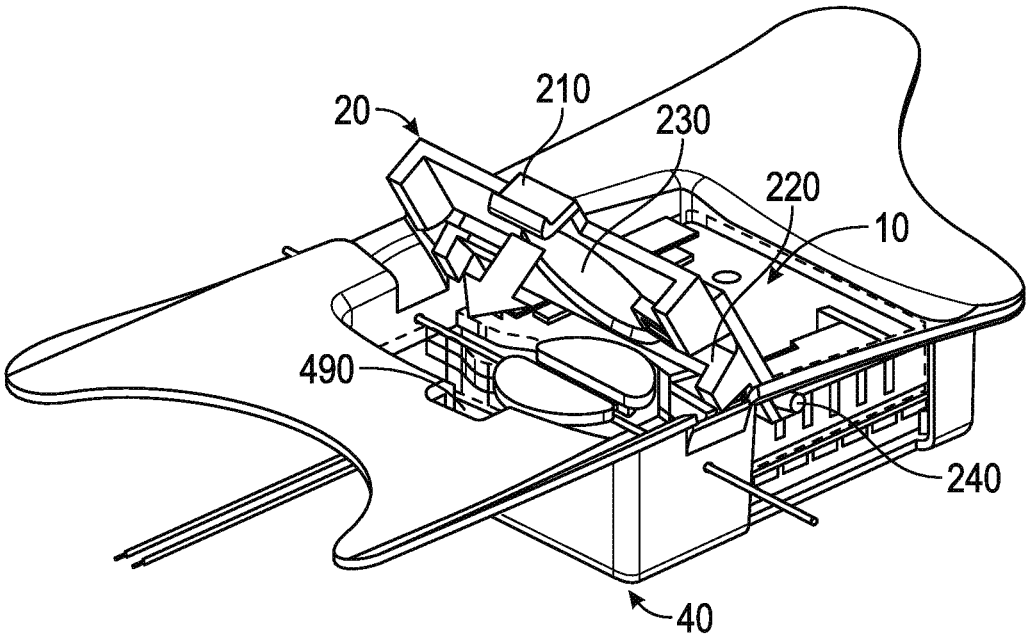

FIGS. 4B-4D illustrate insertion of the lid 20 into the mid-sole plate 40 to retain the lacing engine 10 and capture lace cable 131. In this example, the lid 20 includes features such as latch 210, lid lace guides 220, lid spool recess 230, and lid clips 240. The lid lace guides 220 can include both medial and lateral lid lace guides 220. The lid lace guides 220 assist in maintaining alignment of the lace cable 131 through the proper portion of the lacing engine 10. The lid clips 240 can also include both medial and lateral lid clips 240. The lid clips 240 provide a pivot point for attachment of the lid 20 to the mid-sole plate 40. As illustrated in FIG. 4B, the lid 20 is inserted straight down into the mid-sole plate 40 with the lid clips 240 entering the mid-sole plate 40 via the lid slots 430.

As illustrated in FIG. 4C, once the lid clips 240 are inserted through the lid slots 430, the lid 20 is shifted anteriorly to keep the lid clips 240 from disengaging from the mid-sole plate 40. FIG. 4D illustrates rotation or pivoting of the lid 20 about the lid clips 240 to secure the lacing engine 10 and lace cable 131 by engagement of the latch 210 with a lid latch recess 490 in the mid-sole plate 40. Once snapped into position, the lid 20 secures the lacing engine 10 within the mid-sole plate 40.

Figure 5A:
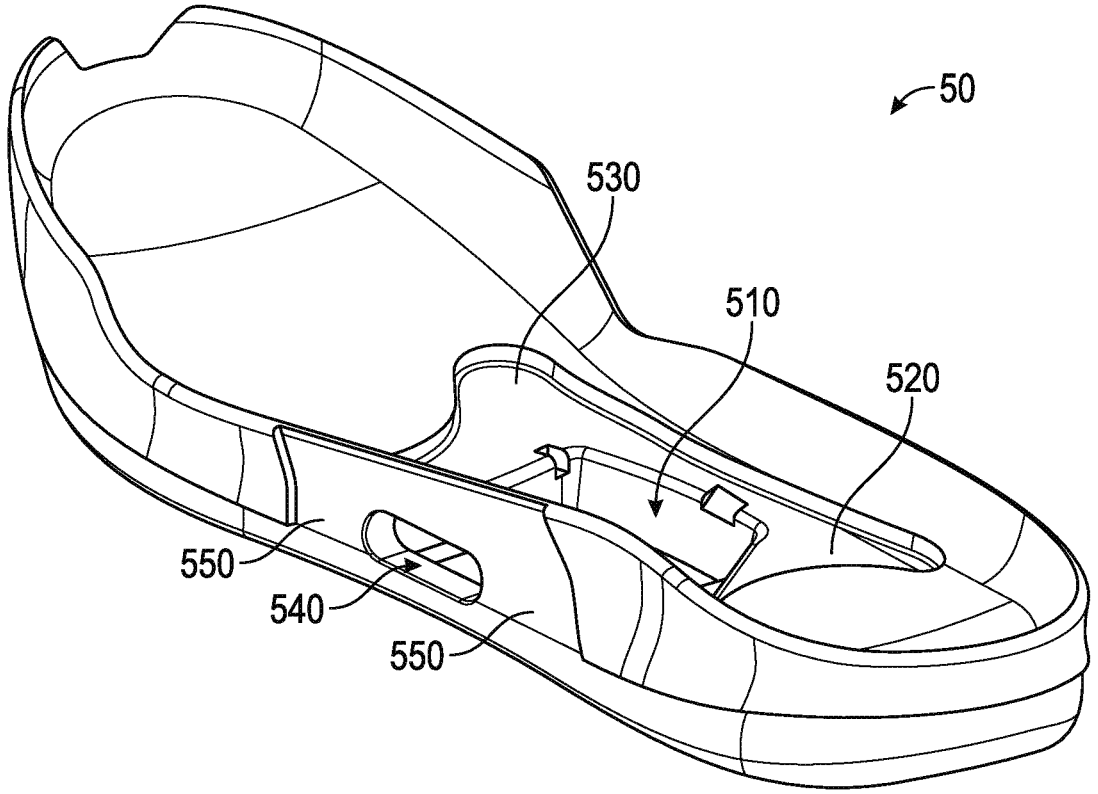
FIGS. 5A-5D are diagrams and drawings illustrating a mid-sole and out-sole to accommodate a lacing engine and related components, according to some example embodiments.
Figure 5B:
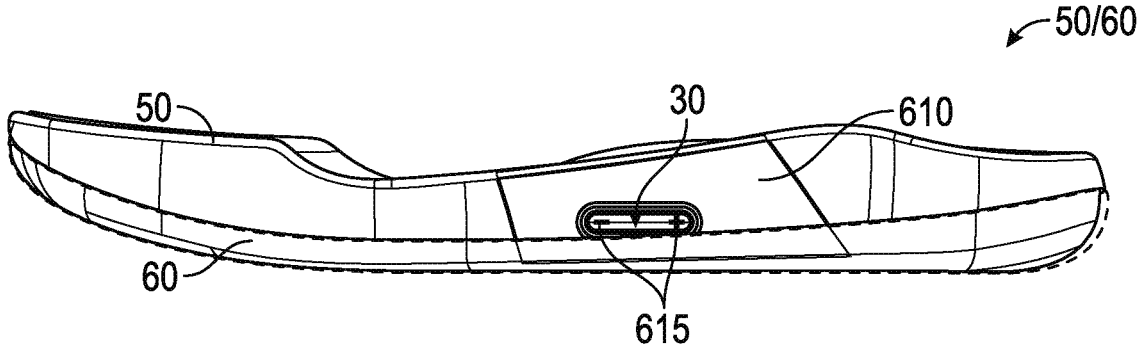
Figure 5C:
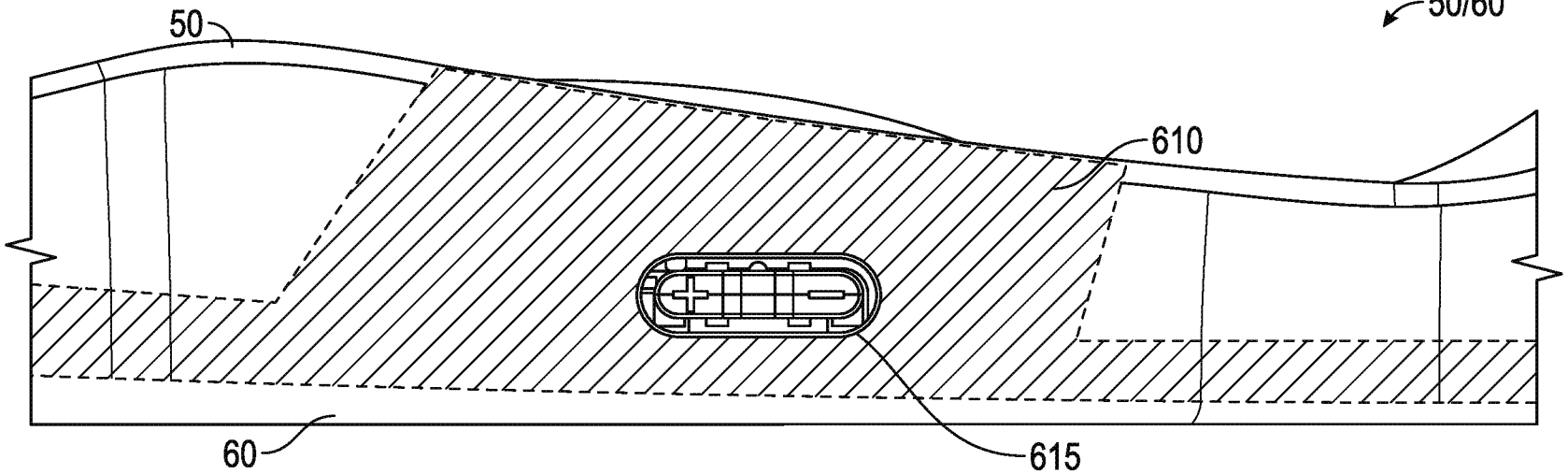

FIGS. 5A-5D are diagrams and drawings illustrating a mid-sole 50 and out-sole 60 configured to accommodate lacing engine 10 and related components, according to some example embodiments. The mid-sole 50 can be formed from any suitable footwear material and includes various features to accommodate the mid-sole plate 40 and related components. In this example, the mid-sole 50 includes features such as plate recess 510, anterior flange recess 520, posterior flange recess 530, actuator opening 540 and actuator cover recess 550. The plate recess 510 includes various cutouts and similar features to match corresponding features of the mid-sole plate 40. The actuator opening 540 is sized and positioned to provide access to the actuator 30 from the lateral side of the footwear platform 1. The actuator cover recess 550 is a recessed portion of the mid-sole 50 adapted to accommodate a molded covering to protect the actuator 30 and provide a particular tactile and visual look for the primary user interface to the lacing engine 10, as illustrated in FIGS. 5B and 5C.

FIGS. 5B and 5C illustrate portions of the mid-sole 50 and out-sole 60, according to example embodiments. FIG. 5B includes illustration of exemplary actuator cover 610 and raised actuator interface 615, which is molded or otherwise formed into the actuator cover 610. FIG. 5C illustrates an additional example of actuator 610 and raised actuator interface 615 including horizontal striping to disperse portions of the light transmitted to the out-sole 60 through the light pipe 320 portion of actuator 30.

Figure 5D:
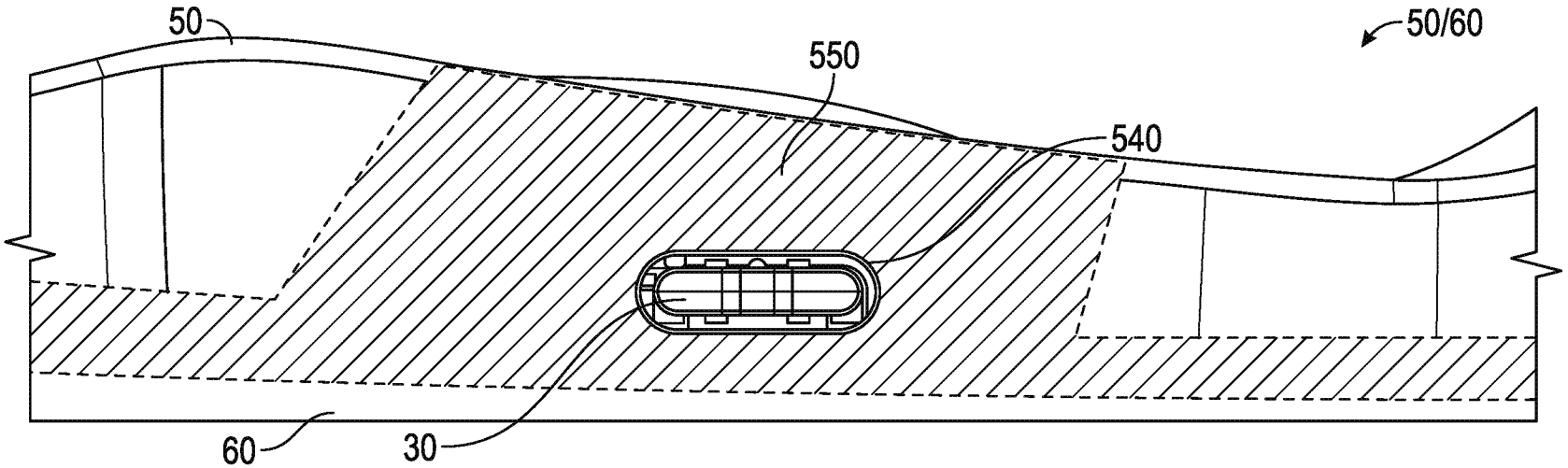

FIG. 5D further illustrates actuator cover recess 550 on mid-sole 50 as well as positioning of actuator 30 within actuator opening 540 prior to application of actuator cover 610. In this example, the actuator cover recess 550 is designed to receive adhesive to adhere actuator cover 610 to the mid-sole 50 and out-sole 60.

Figure 6A:
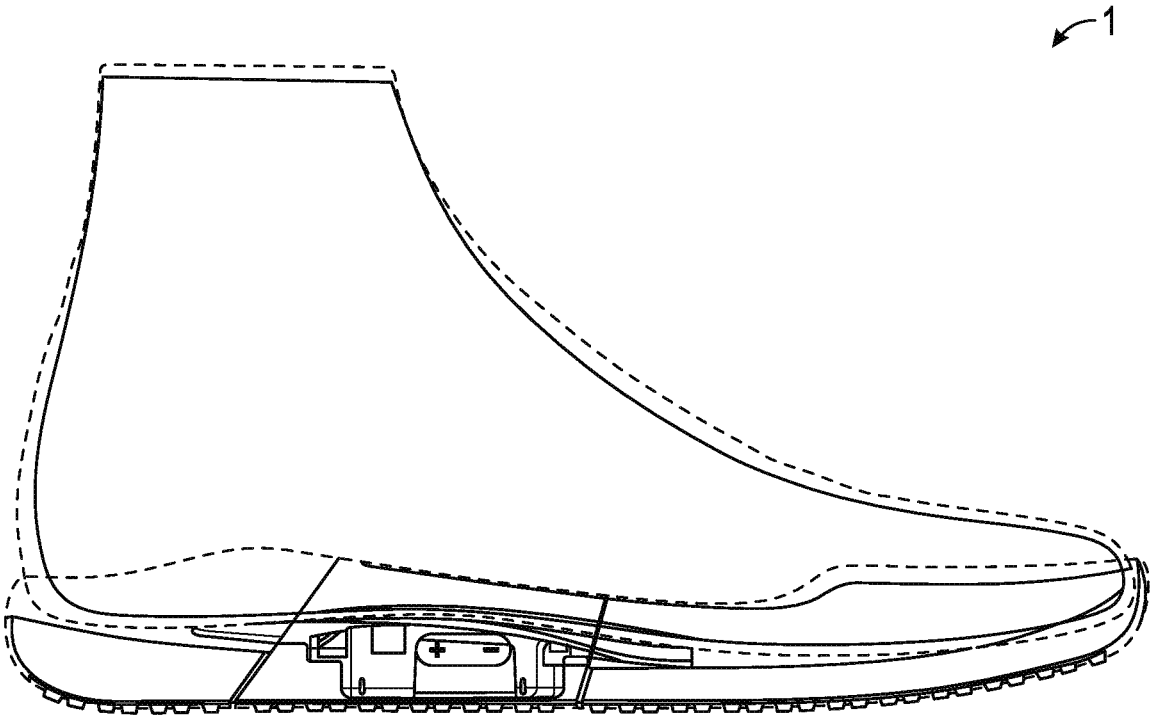
FIGS. 6A-6D are illustrations of a footwear assembly including a motorized lacing engine, according to some example embodiments.
Figure 6B:
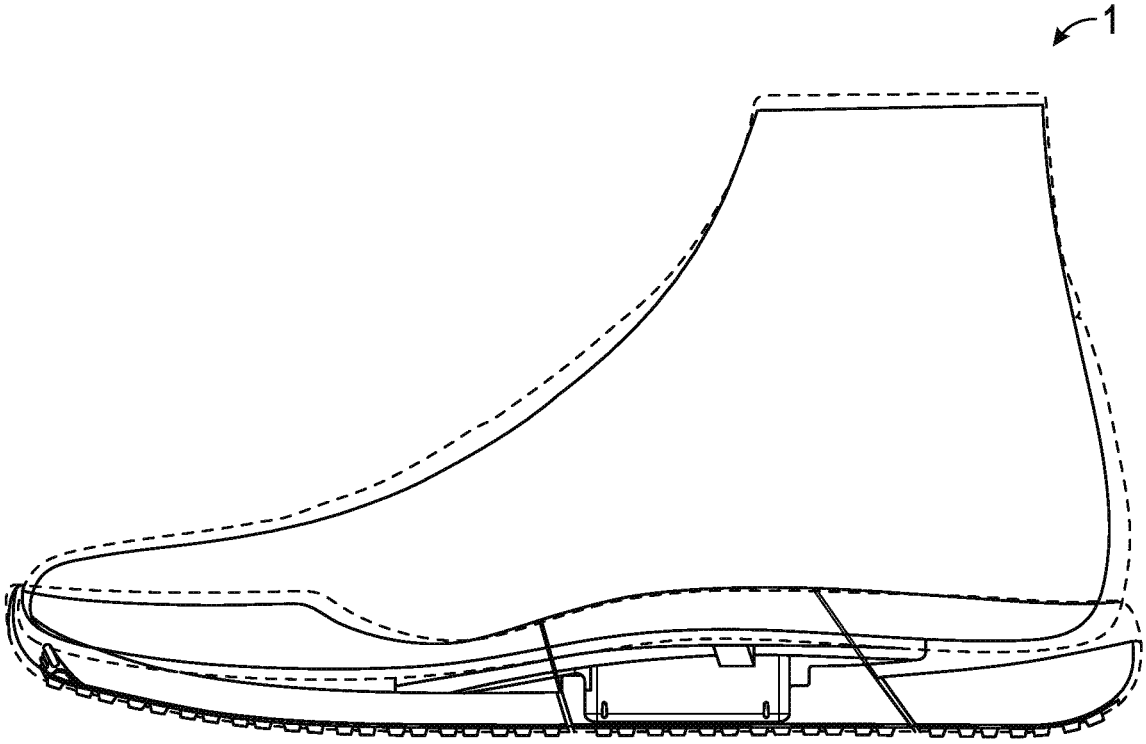
Figure 6C:
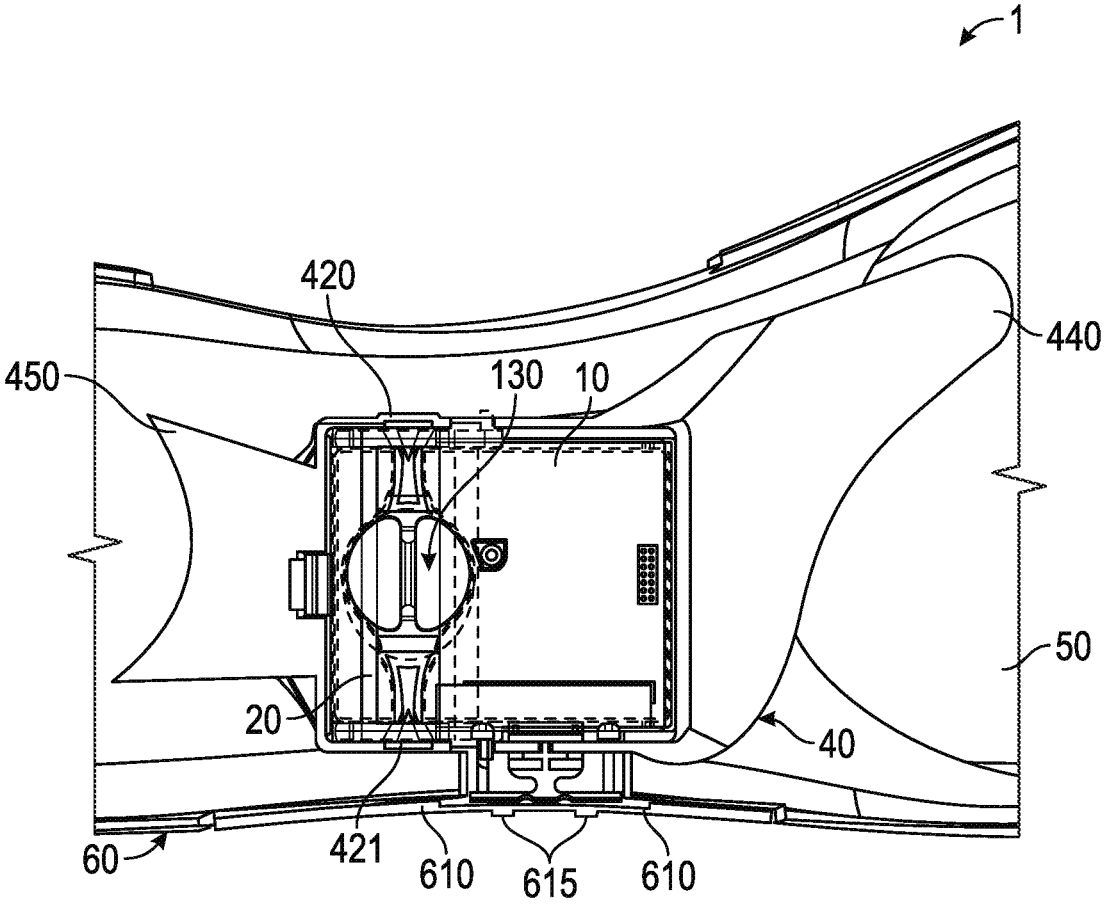

FIGS. 6A-6D are illustrations of a footwear assembly 1 including a motorized lacing engine 10, according to some example embodiments. In this example, FIGS. 6A-6C depict transparent examples of an assembled automated footwear platform 1 including a lacing engine 10, a mid-sole plate 40, a mid-sole and an out-sole 60. FIG. 6A is a lateral side view of the automated footwear platform 1. FIG. 6B is a medial side view of the automated footwear platform 1. FIG. 6C is a top view, with the upper portion removed, of the automated footwear platform 1. The top view demonstrates relative positioning of the lacing engine 10, the lid 20, the actuator 30, the mid-sole plate 40, the mid-sole 50, and the out-sole 60. In this example, the top view also illustrates the spool 130, the medial lace guide 420 the lateral lace guide 421, the anterior flange 440, the posterior flange 450, the actuator cover 610, and the raised actuator interface 615.

Figure 6D:
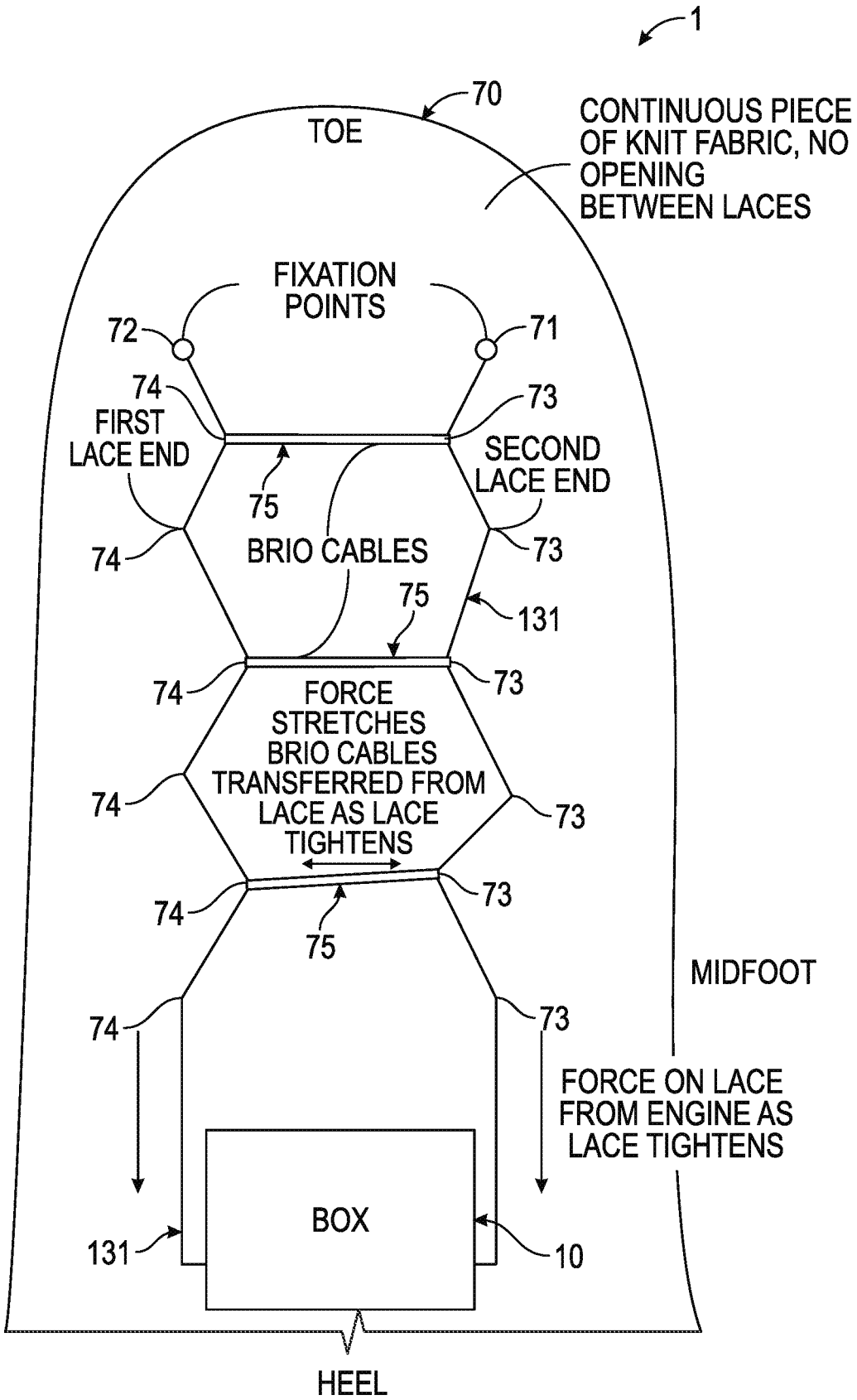

FIG. 6D is a top view diagram of upper 70 illustrating an example lacing configuration, according to some example embodiments. In this example, the upper 70 includes lateral lace fixation 71, medial lace fixation 72, lateral lace guides 73, medial lace guides 74, and brio cables 75, in additional to lace 131 and lacing engine 10. The example illustrated in FIG. 6D includes a continuous knit fabric upper 70 with diagonal lacing pattern involving non-overlapping medial and lateral lacing paths. The lacing paths are created starting at the lateral lace fixation running through the lateral lace guides 73 through the lacing engine 10 up through the medial lace guides 74 back to the medial lace fixation 72. In this example, lace 131 forms a continuous loop from lateral lace fixation 71 to medial lace fixation 72. Medial to lateral tightening is transmitted through brio cables 75 in this example. In other examples, the lacing path may crisscross or incorporate additional features to transmit tightening forces in a medial-lateral direction across the upper 70. Additionally, the continuous lace loop concept can be incorporated into a more traditional upper with a central (medial) gap and lace 131 crisscrossing back and forth across the central gap.

FIGS. 7A-7M are illustrations of an actuator used to control an automated lacing engine, according to some example embodiments. Actuator 720 in combination with bushing 710 is an alternative design to actuator 30 discussed above. As illustrated in FIGS. 7A-7M, the bushing 710 and actuator 720 interface with mid-sole plate 40, but the point of interface includes some alterations from the mid-sole plate 40 discussed above, the alterations are discussed below (see e.g., FIG. 7B; bushing cutout 741, bushing key recess 742, superior bushing retention ridge 743, and inferior bushing retention ridges 744). Like actuator 30, actuator 720 is designed to provide a physical interface between an out-sole portion of the footwear and a lacing engine, such as lacing engine 10. The actuator 720 includes structures designed to interface with switches 122 on lacing engine 10 (as discussed and illustrated above). Actuator 720 itself, is not illustrated as being a light pipe for conducting light from LEDs within the lacing engine. However, the actuator 720 could be constructed from materials suitable for operating as a light pipe to transmit light from the LEDs within a lacing engine, much as described in reference to actuator 30.

Figure 7A:
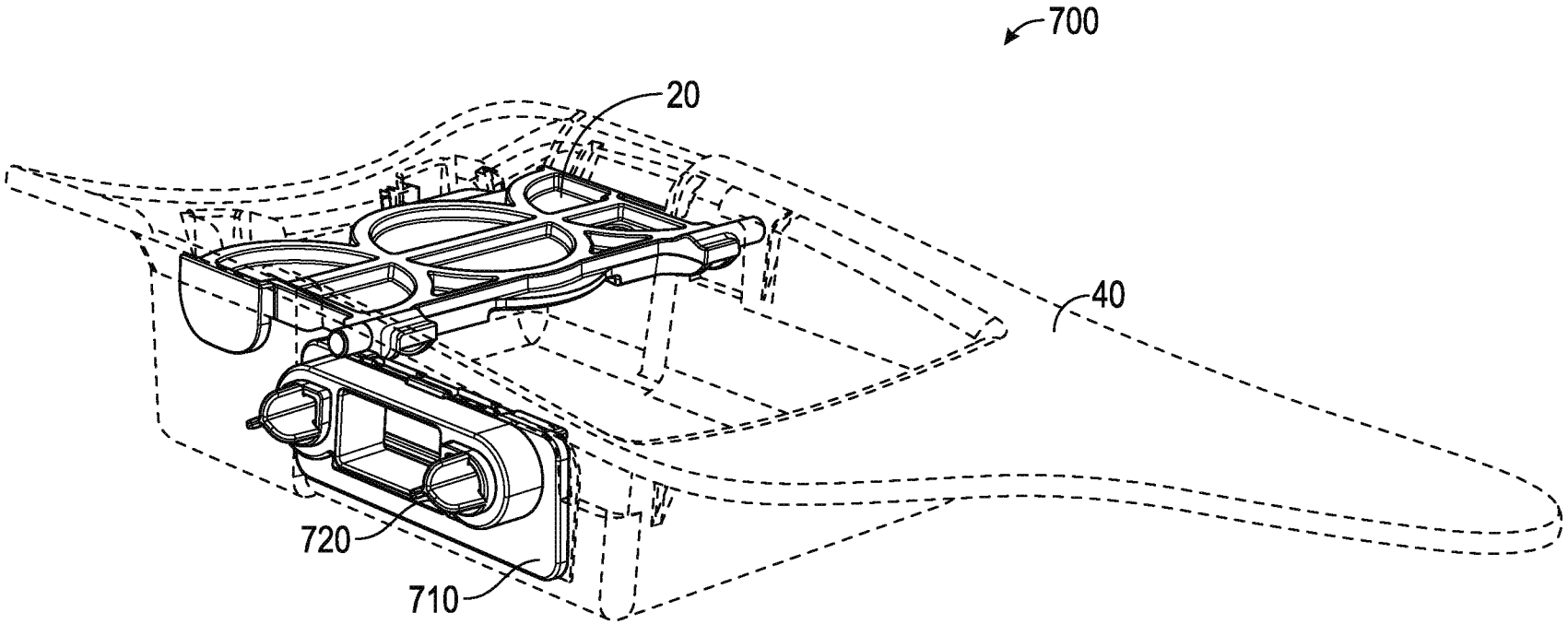
FIGS. 7A-7M are illustrations of an actuator used to control an automated lacing engine, according to some example embodiments.

FIG. 7A is an exterior perspective view of mid-sole plate 40 configured to contain bushing 710 and actuator 720. In this example, the bushing 710 and actuator 720 are positioned in a lateral side of mid-sole plate 40 to provide a physical interface between the lateral side of out-sole 60 and the lateral side of lacing engine 10. As discussed in greater detail below, the actuator 720 includes two exterior interface structures to receive button (switch) activations from a user via out-sole 60, such as through raised actuator interface 615. Other embodiments of the footwear platform could include an actuator on the medial side of the assembly. FIG. 7A illustrates how a majority of the bushing structure is disposed on or in an external surface of the mid-sole plate 40. The following figure illustrates the interior interface between bushing 710 and mid-sole plate 40.

Figure 7B:
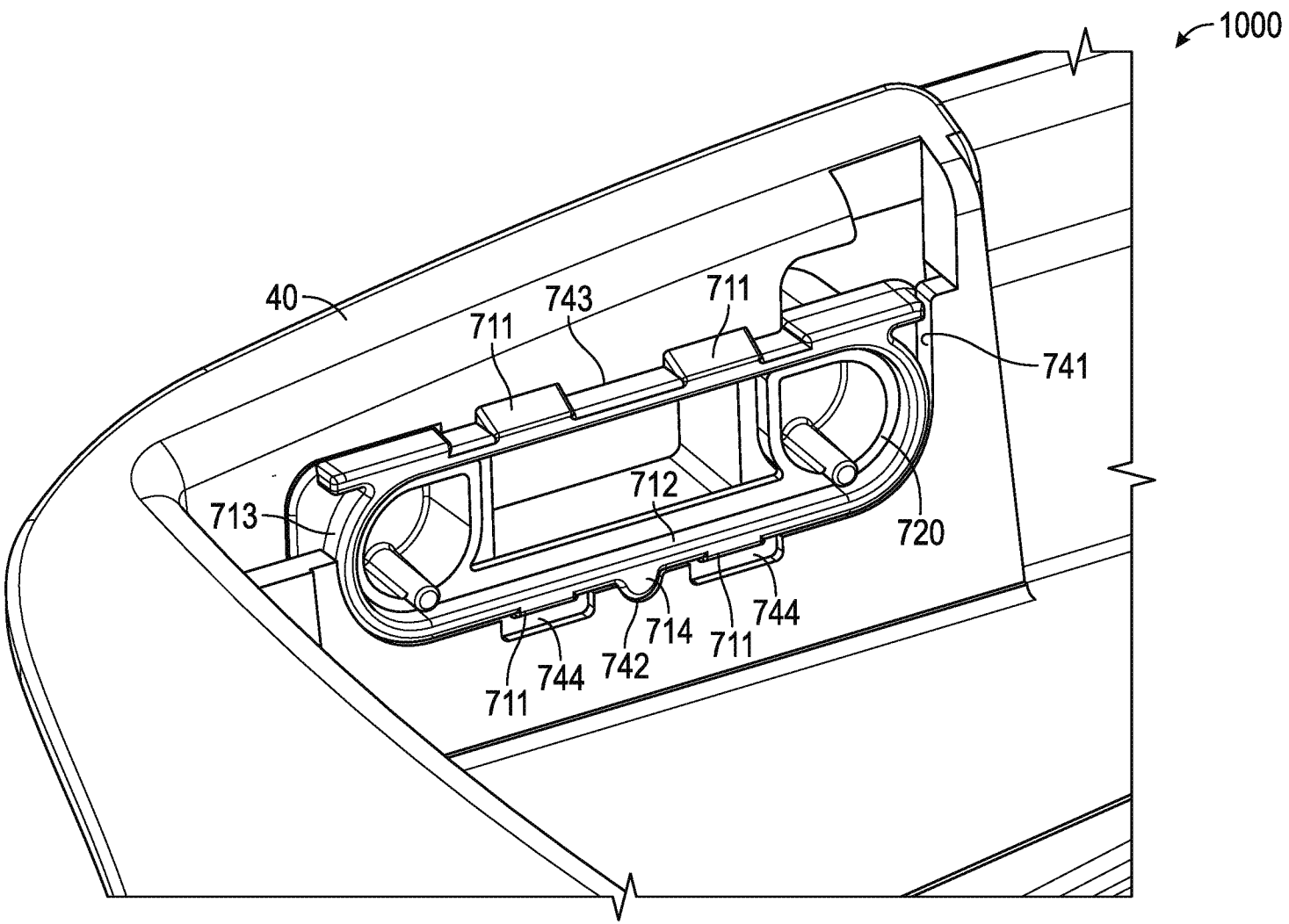

FIG. 7B is an interior perspective view of a portion of mid-sole plate configured to contain bushing 710 and actuator 720. In this example, the mid-sole plate 40 includes bushing cutout 741, which allows a portion of bushing 710 to extend into mid-sole plate 40 from an exterior where an outer flange 719 of bushing 710 abuts an exterior surface of the mid-sole plate 40. The bushing 710 includes interior retention clips 711 that produce a snap-fit with specific portions of the bushing cutout 741, such as superior bushing retention ridge 743 and inferior bushing retention ridges 744. The bushing 710 also includes a recess lip 713 that interfaces with a portion of the bushing cutout 741. The bushing 710 also includes bushing key 714 that aligns with bushing key recess 742. The bushing key 714 and bushing key recess 742 cooperate to align and stabilize the bushing 710 within the bushing cutout 741. As will be discussed below in reference to additional figures, the actuator 720 is movable linearly in a primarily medial-lateral direction within the bushing 710.

Figure 7C:
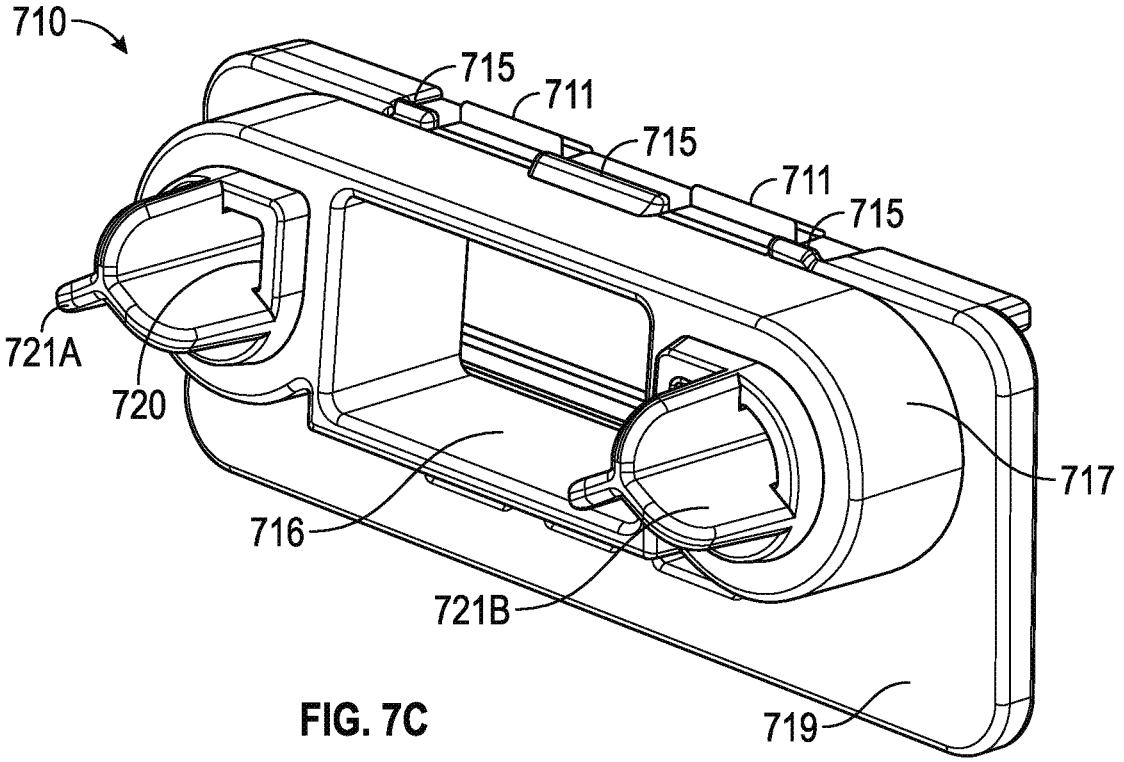

FIG. 7C is an exterior perspective view of the bushing 710 and the actuator 710, according to an example embodiment. In this example, the bushing 710 can include interior retention clips 711, exterior retention clips 715, light aperture 716, actuator housing 717, and outer flange 719. The actuator 720 is illustrated as including exterior interface ribs 721A, 721B (collectively referred to as exterior interface ribs 721) extending exteriorly from within actuator housing 717 (or from the actuator bodies 722A, 722B as shown in FIG. 7G). The exterior interface ribs 721 provide the primary physical interface between out-sole 60 and the actuator 720. In this example, exterior interface ribs, such as exterior interface ribs 721A, include three ribs extending radially outward from a common center with rounded outer edges. In this example, when viewed from straight on (see FIG. 7G), the exterior interface ribs form a equilateral Y structure. In other examples (not illustrated), the actuator 720 can include a cylindrical or solid structure extending exteriorly from the bushing housing 717 to interface with the out-sole 60. In this example, the bushing 710 includes light aperture 716, which can function to transmit light from LEDs within a lacing engine, such as lacing engine 10. In this example, light aperture 716 is a square opening centered between the exterior interface ribs 721A, 721B of the actuator 720. The light aperture 716 can allow light from the lacing engine to shine through to the out-sole 60, which can include translucent materials designed to enable external visualization of light from a lacing engine.

Figure 7D:
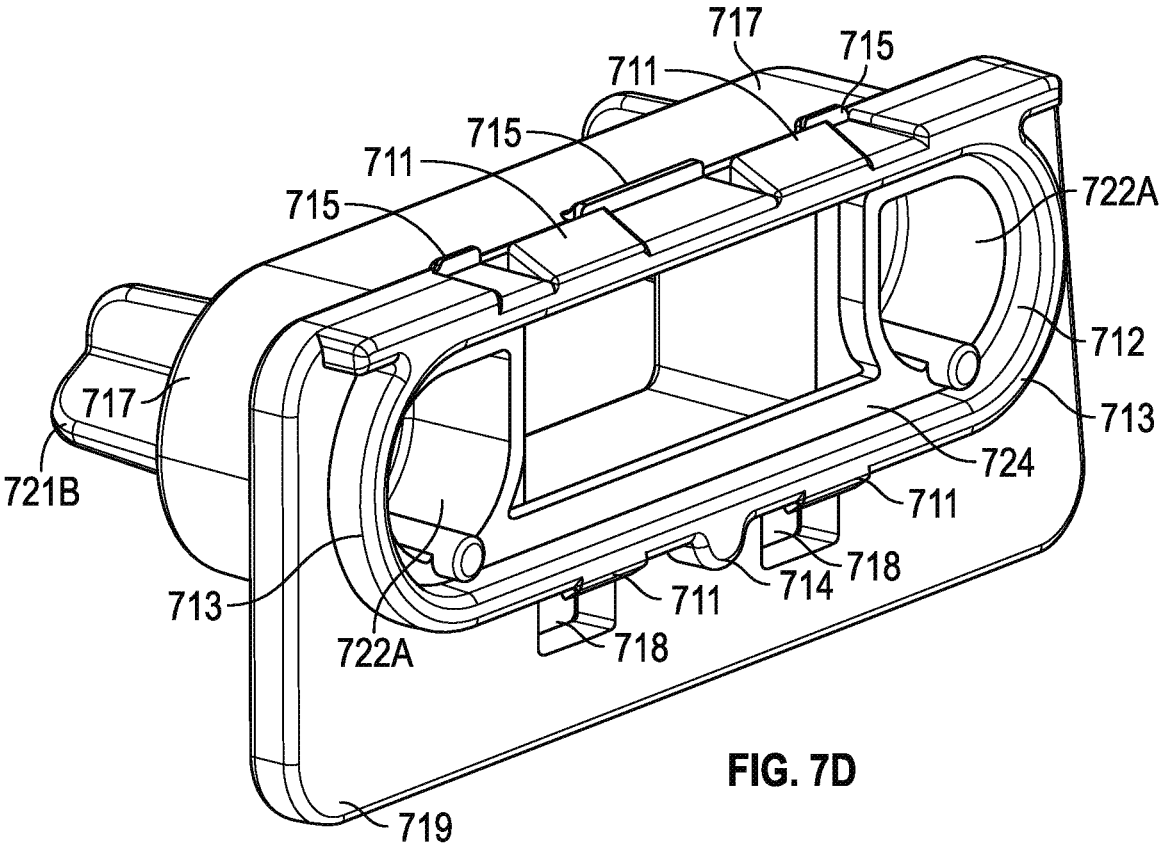

FIG. 7D is an interior perspective view of the bushing 710 and the actuator 710. In this example, the bushing 710 can include interior retention clips 711, actuator recess 712, a recess lip 713, a bushing key 714, exterior retention clips 715, actuator housing 717, inferior recesses 718, and outer flange 719. The actuator 720 can include connector 724 that connects the two actuator bodies 722A, 722B. In an example, the connector 724 is dimensioned (e.g., having a sufficiently small cross-section) to allow each of the actuator bodies 722A, 722B to move substantially independently when pressed. Accordingly, when one of the actuator bodies 722A, 722B is pressed via exterior interface ribs 721A, 721B, the connector 724 defects or bends to enable the other actuator body 722A, 722B to remain substantially stationary. In this example, substantially stationary means that the actuator body moves less than an amount necessary to activate the corresponding switch 122 on lacing engine 10.

FIG. 7D illustrates the relative positions of exterior retention clips 715 and interior retention clips 711 on bushing 710. The exterior retention clips 715 and interior retention clips 711 operate in cooperation to capture portions of the mid-sole plate 40 bushing cutout 741. In an example, the exterior retention clips 715 and interior retention clips 711 abut opposite sides of portion of the superior bushing retention ridge 743 and the inferior bushing retention ridge 744. In some examples, the interior retention clips 711 are ramped to enable the bushing 710 to be snapped into the mid-sole plate 40 from an exterior side, such as a lateral exterior side. The ramped surfaces facilitate deflection of edges of the cutout 741 and/or portions of bushing 710.

As illustrated in FIGS. 7C and 7D, the actuator housing 717 portion of the bushing 710 extends outward from the outer flange 719 to form bores for each of the actuator bodies 722A, 722B as well as the light aperture 716. In this example, the side portions of the actuator housing 717 around rounded with a radius of curvature commentary to corresponding portions of the actuator bodies 722A, 722B.

Figure 7E:
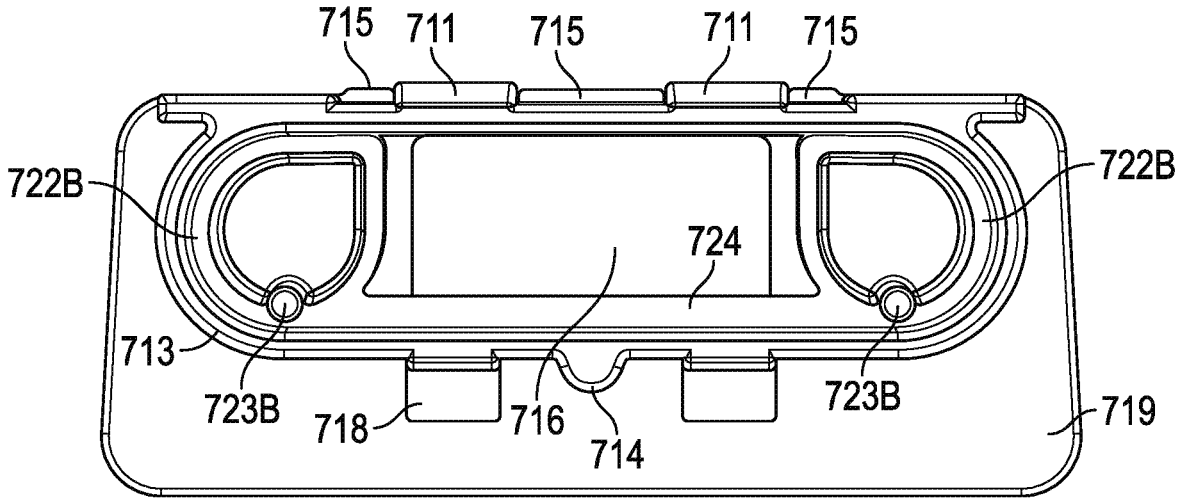

FIG. 7E is an internal or rear view of the actuator 720 and bushing 710 assembly according to an example embodiment. In this example, the bushing 710 is illustrated as including interior retention clips 711, recess lip 713, bushing key 714, exterior retention clips 715, light aperture 716, inferior recesses 718, and outer flange 719. In this example, the actuator 710 includes the connector 724, actuator bodies 722A, 722B, and switch interface 723A, 723B, which are visible in this figure. The switch interfaces 723A, 723B are structures designed to physically interface with the switches 122 on lacing engine 10. In this example, the switch interfaces 723A, 723B are cylindrical extensions from an interferior portion of the actuator bodies 722A, 722B. In other examples, the switch interfaces 723A, 723B can be different shapes or sizes that correspond to switches 122.

Figure 7F:
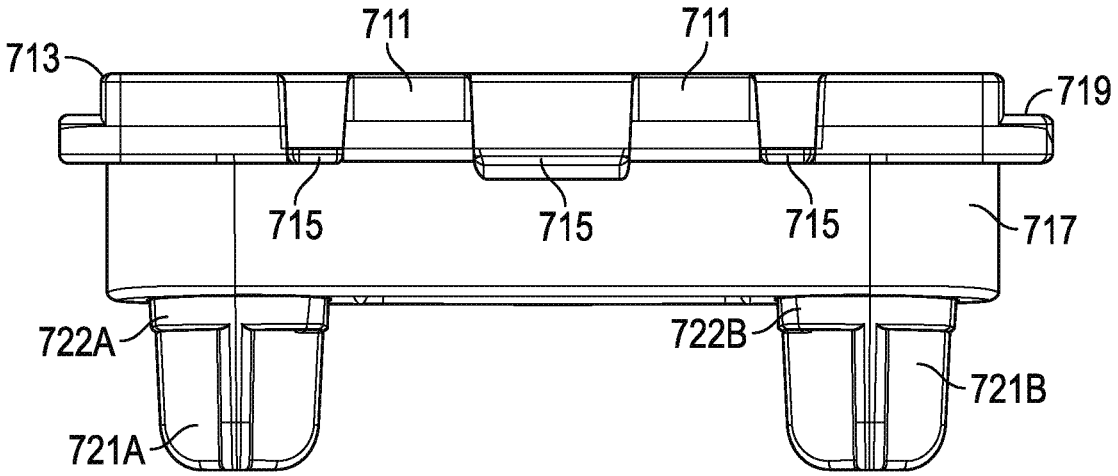
Figure 7G:
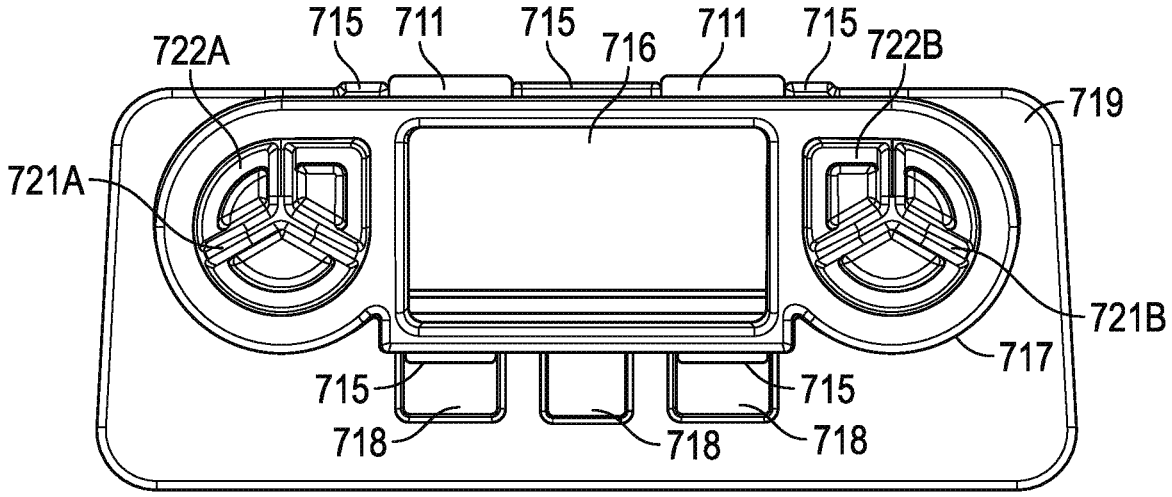

FIG. 7F is a top view of bushing 710 and actuator 720 assembly according to an example embodiment. In this example, the bushing 710 can include interior retention clips 711, recess lip 713, exterior retention clips 715, actuator housing 717, and outer flange 719. In view illustrates the actuator bodies 722A, 722B and exterior interface ribs 721A, 721B portions of the actuator 710.

FIG. 7G is an external or front view of the bushing 710 and actuator 720 assembly according to an example embodiment. In this example, the bushing 710 is illustrated as including interior retention clips 711, exterior retention clips 715, light aperture 716, actuator housing 717, inferior recesses 718, and outer flange 719. In this example, the actuator 720 is illustrated as including exterior interface ribs 721A, 721B and actuator bodies 722A, 722B. The front view illustrates the tear-drop shape of the actuator bodies 722A, 722B. Each actuator body 722 includes a squared off corner to assist in alignment, forming a keying structure for the actuator 720 interface to the bushing 710. Actuator body 722A is a mirror image of actuator body 722B with the squared off corners on the upper inside portion of each actuator body.

Figure 7H:
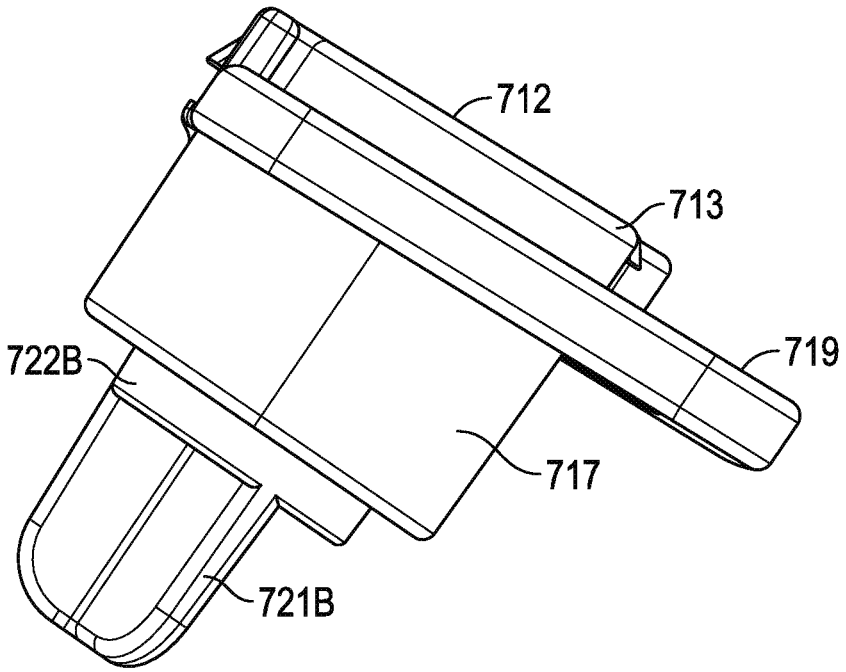

FIG. 7H is a side view of the bushing 710 and actuator 720 assembly according to an example embodiment. The side illustrates the actuator recess 712, recess lip 713, actuator housing 717, and outer flange 719 portions of bushing 710. The assembly side view also illustrates the exterior interface ribs 721B and actuator body 722B portions of the actuator 720.

Figure 7I:
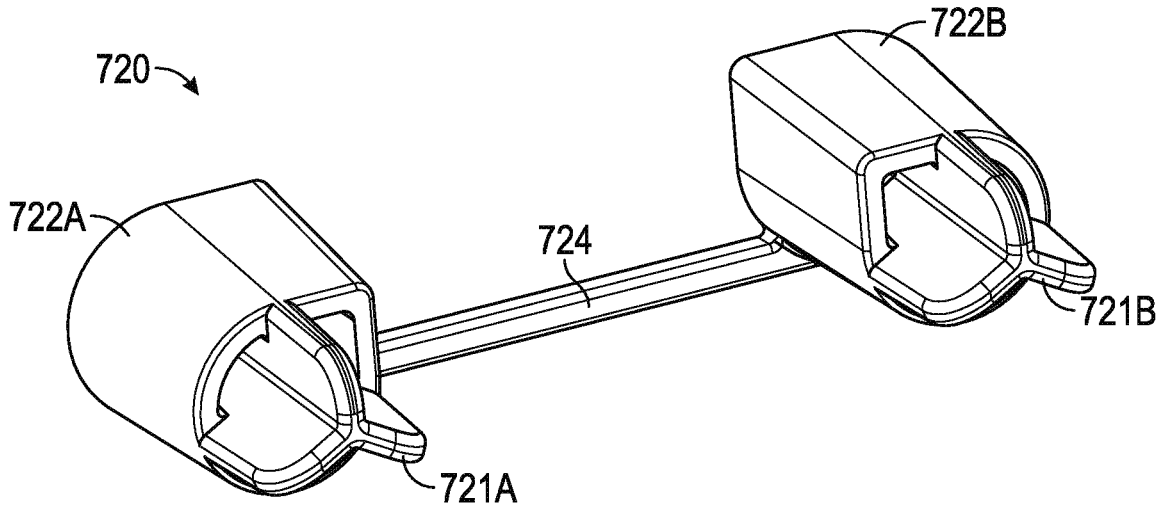

FIG. 7I is a front perspective view of actuator 720 according to an example embodiment. In this example, the actuator 720 includes actuator bodies 722A, 722B, connector 724, and exterior interface ribs 721A, 721B. The front perspective view illustrates how the actuator bodies 722A, 722B are slightly tapered from a slightly narrower front near exterior interface ribs and getting wider towards the back portions. The view also provides an additional view of the squared off corner of each actuator body, that provides a keying feature to align the actuator 720 with bushing 710. The tapered bodies operate to hold the actuator 720 within the bushing 710, such as preventing the actuator from pushing out on an exterior side.

Figure 7J:
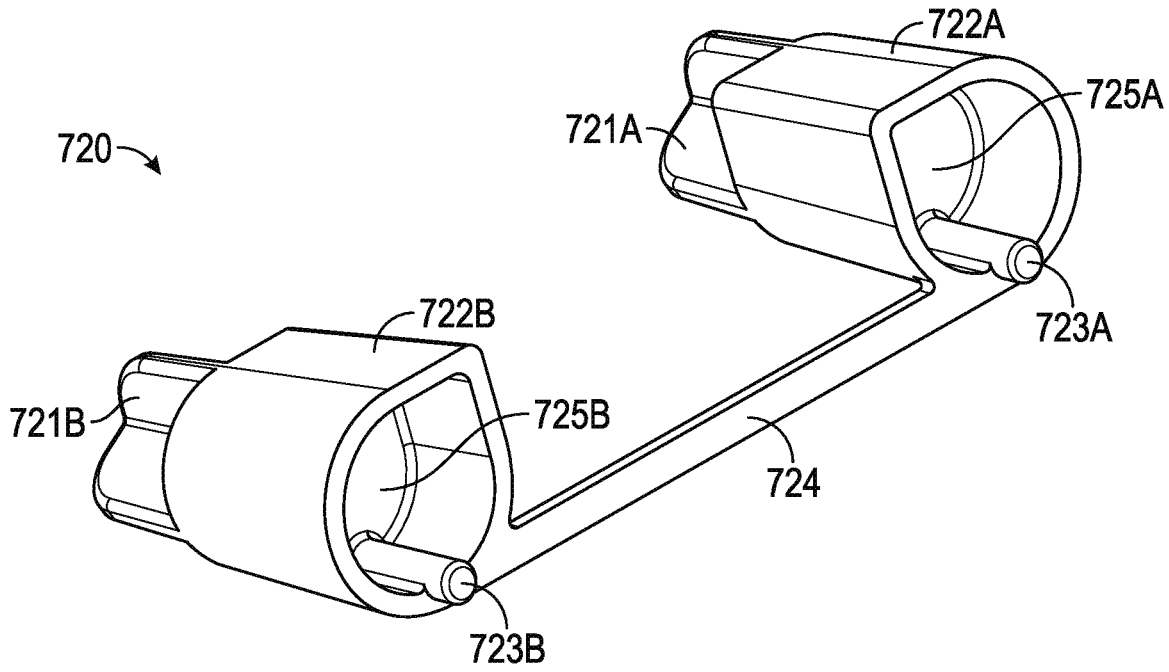

FIG. 7J is a rear perspective view of actuator 710 according to an example embodiment. In this example, the actuator 720 includes exterior interface ribs 721A, 721B, actuator bodies 722A, 722B, switch interfaces 723A, 723B, connector 724, and actuator recesses 725A, 725B. The actuatror recesses 725A, 725B operate to reduce weight, while not sacrificing any appreciable strength or rigidity.

Figure 7K:
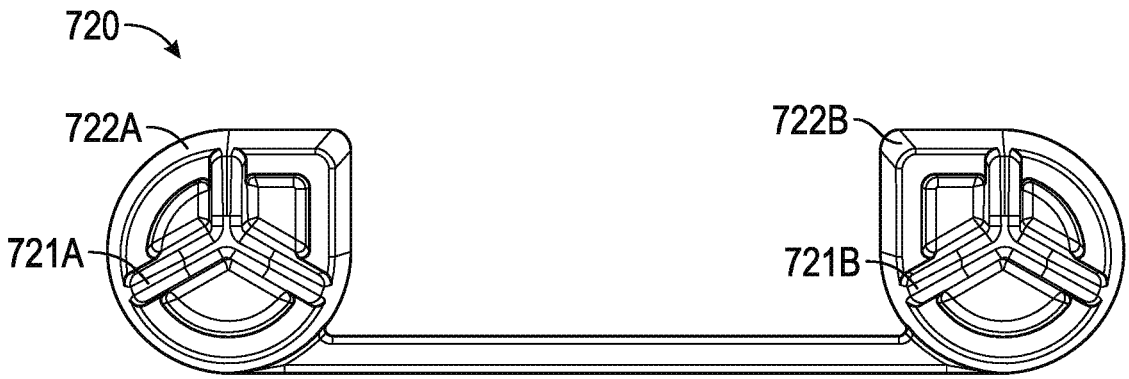

FIG. 7K is a front view of actuator 720 according to an example embodiment. In this view, the actuator 720 includes exterior interface ribs 721A, 721B and actuator bodies 722A, 722B. In this example, each group of exterior interface ribs 721A, 721B includes three individual ribs connected at a central point to form an equilateral Y shape structure. Each of the ribs can have a rounded or radiused external edge, as shown in other figures.

Figure 7L:
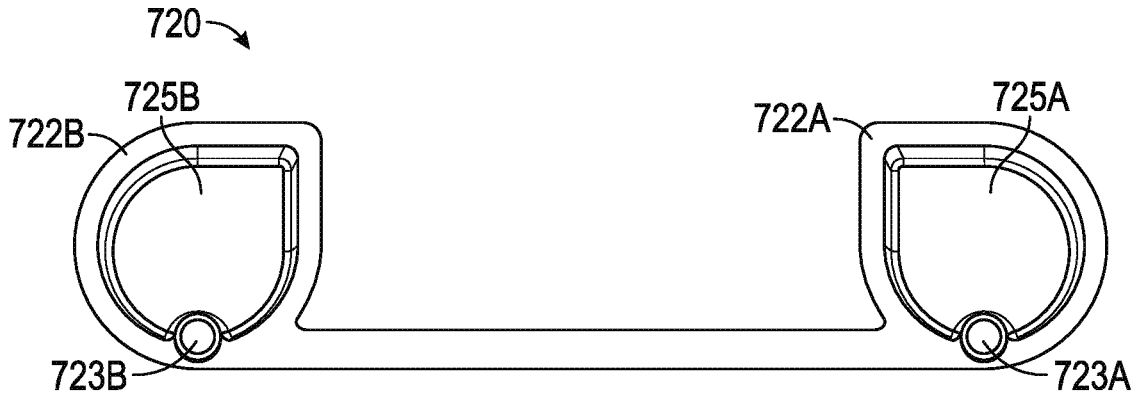

FIG. 7L is a rear view of actuator 720 according to an example embodiment. In this view, the actuator 720 includes visible elements such as actuator bodies 722A, 722B, switch interfaces 723A, 723B, and actuator recesses 725A, 725B. The rear view illustrates the mirrored tear-drop shape of the actuator bodies 722A, 722B, with upper medial corners squared off and rounded lower lateral portions. The rear view also illustrates the inferior orientation of the switch interfaces 723A, 723B.

Figure 7M:
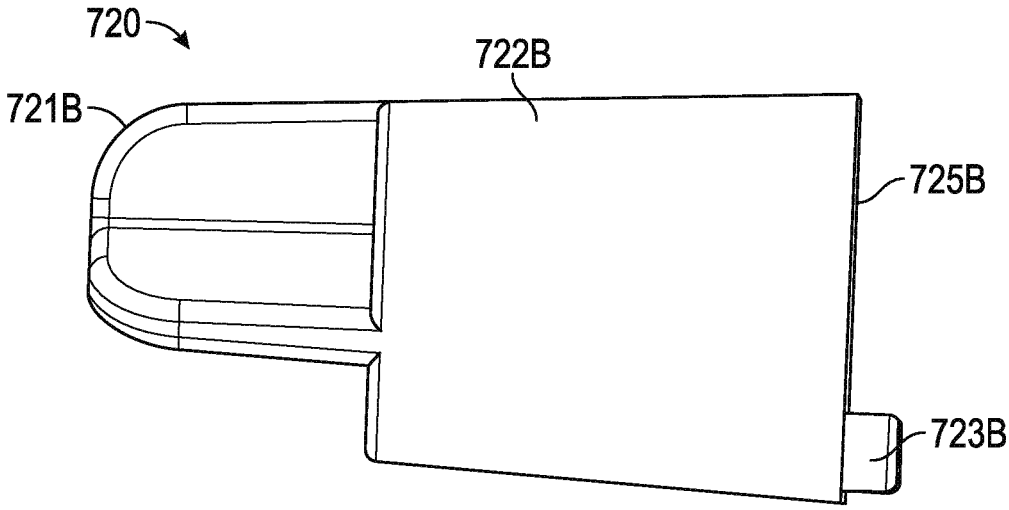

FIG. 7M is a side view of actuator 720 according to an example embodiment. In this view, the actuator 720 includes visible elements such as exterior interface ribs 721B, actuator body 722B, and switch interface 723B. In this view, the switch interface 723B extends internally along a inferior edge of the actuator body 722B. The location of actuator recess 725B is also noted in the figure. The upper rib of exterior interface ribs 721B illustrates the profile of all ribs in this example.

The actuator embodiment illustrated in FIGS. 7A-7M is discussed above in terms that are somewhat unique and different from the embodiment illustrated in FIGS. 3A-3D. However, the actuator 720 can be described using similar terminology to that used in the previous embodiment. The actuator 720 includes actuator bodies 722A, 722B, which are comparable to a posterior arm and an anterior arm. The actuator 720 also includes a connector 724, which is comparable to a bridge structure as discussed above.

Figure 8:
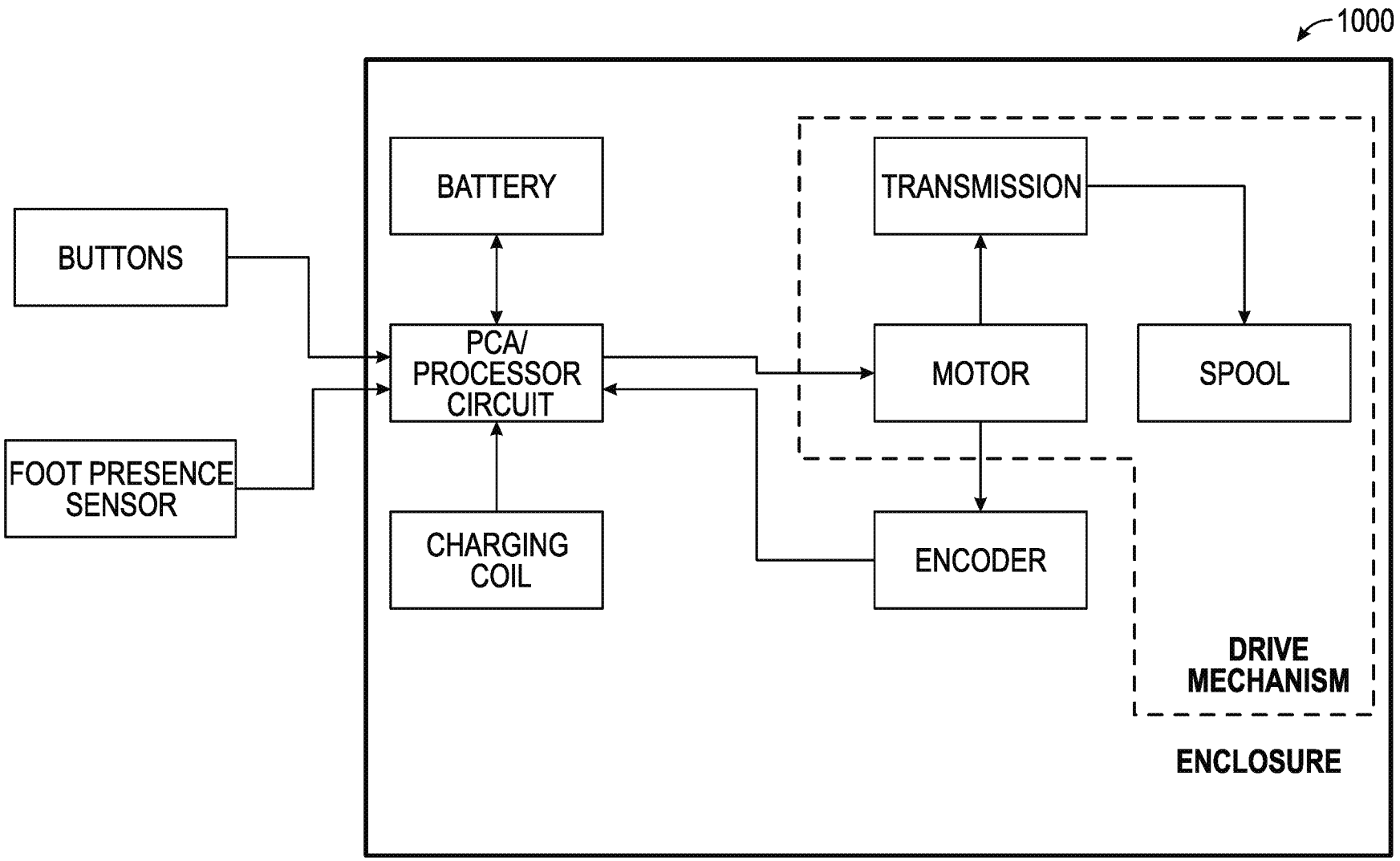
FIG. 8 is a block diagram illustrating components of a motorized lacing system, according to some example embodiments.

FIG. 8 is a block diagram illustrating components of a motorized lacing system for footwear, according to some example embodiments. The system 1000 illustrates basic components of a motorized lacing system such as including interface buttons, foot presence sensor(s), a printed circuit board assembly (PCA) with a processor circuit, a battery, a charging coil, an encoder, a motor, a transmission, and a spool. In this example, the interface buttons and foot presence sensor(s) communicate with the circuit board (PCA), which also communicates with the battery and charging coil. The encoder and motor are also connected to the circuit board and each other. The transmission couples the motor to the spool to form the drive mechanism.

In an example, the processor circuit controls one or more aspects of the drive mechanism. For example, the processor circuit can be configured to receive information from the buttons and/or from the foot presence sensor and/or from the battery and/or from the drive mechanism and/or from the encoder, and can be further configured to issue commands to the drive mechanism, such as to tighten or loosen the footwear, or to obtain or record sensor information, among other functions.

EXAMPLES

The present inventors have recognized, among other things, a need for an improved modular lacing engine for automated and semi-automated tightening of shoe laces. This document describes, among other things, the mechanical design of an actuator assembly for controlling an automated modular lacing engine within a footwear platform. The following examples provide a non-limiting examples of the actuator and footwear assembly discussed herein.

Example 1 describes subject matter including an actuator to control a lacing engine within an automated footwear platform. The actuator can comprise a posterior arm, an anterior arm, a central arm, and a bridge structure. In this example, the posterior arm can include a first switch end to activate a first switch on the lacing engine. The anterior arm can include a second switch end to activate a second switch on the lacing engine. The central arm can include a light pipe to channel light from one or more LEDs within the lacing engine. The bridge structure can connect the posterior arm, the anterior arm and the central arm.

In Example 2, the subject matter of Example 1 can optionally include the bridge structure distributing light channeled by the light pipe from at least the posterior arm to the anterior arm.

In Example 3, the subject matter of any one of Examples 1 and 2 can optionally include the bridge structure including anterior and posterior flanges extending beyond respective connection points of the anterior arm and the posterior arm.

In Example 4, the subject matter of any one of Examples 1 to 3 can optionally include the bridge structure, the central arm, the posterior arm, and the anterior arm functioning to enable selective activation of the first switch, the second switch, or both the first switch and the second switch simultaneously.

In Example 5, the subject matter of any one of Examples 1 to 4 can optionally include the posterior arm and the anterior arm each including a stop structure to inhibit over actuation of the first switch and the second switch.

In Example 6, the subject matter of any one of Examples 1 to 5 can optionally include the central arm including a medial end that abuts an exterior surface of the lacing engine.

In Example 7, the subject matter of Example 6 can optionally include at least a portion of the exterior surface of the lacing engine being abutted by the medial end of the central arm and including a translucent portion allowing light from the one or more LEDs to reach the central arm.

In Example 8, the subject matter of any one of Examples 1 to 7 can optionally include the bridge structure including a lateral surface covered by a portion of the outsole of the footwear platform to form an interface for receiving user inputs to actuate the first switch, the second switch, or both the first switch and the second switch.

Example 9 describes subject matter including a button assembly for controlling a lacing engine within an automated footwear platform. In this example, the button assembly can include a bushing and an actuator. The bushing can include an actuator housing surrounded by an outer flange. The actuator housing can include an exterior side and an interior side relative to the footwear platform. The actuator can include a plurality of actuator bodies disposed within the actuator housing. Each actuator body of the plurality of actuator bodies can include a switch interface adapted to interact with a switch on a lacing engine.

In Example 10, the subject matter of Example 9 can optionally include each actuator body of the plurality of actuator bodies having a tear-drop cross sectional shape.

In Example 11, the subject matter of any one of Examples 9 and 10 can optionally include each actuator body of the plurality of actuator bodies having an external interface extending exteriorly from the actuator housing when the actuator body is seated within the actuator housing.

In Example 12, the subject matter of Example 11 can optionally include the external interface including a set of interface ribs extend radially outward from each other to form a Y-shaped structure.

In Example 13, the subject matter of Example 12 can optionally include each rib of the set of interface ribs having a rounded outer exterior edge.

In Example 14, the subject matter of any one of Examples 9 to 13 can optionally include the bushing having an aperture to conduct light from LEDs within the lacing engine.

In Example 15, the subject matter of Example 14 can optionally include the aperture being disposed within a central portion of the actuator housing.

In Example 16, the subject matter of Example 15 can optionally include the plurality of actuator bodies having an anterior actuator body disposed on a first side of the aperture and a posterior actuator body disposed on a second side of the aperture.

In Example 17, the subject matter of Example 16 can optionally include the anterior actuator body being a mirror image of the posterior actuator body.

In Example 18, the subject matter of any one of Examples 9 to 17 can optionally include the actuator housing having a recess lip extending from an interior side of the outer flange to form an actuator recess to hold the plurality of actuator bodies.

In Example 19, the subject matter of Example 18 can optionally include the recess lip having a bushing key extending from an inferior portion of the recess lip, the bushing key providing alignment with a bushing cutout in a mid-sole plate portion of the footwear platform.

In Example 20, the subject matter of Example 18 can optionally include the recess lip having interior retention clips to engage an interior bushing retention ridge on a mid-sole plate portion of the footwear platform.

In Example 21, the subject matter of Example 20 can optionally include a superior edge of the outer flange having exterior retention clips to engage an exterior bushing retention ridge on the mid-sole plate portion of the footwear platform.

Example 22 describes subject matter including a footwear assembly. In this example, the footwear assembly can include an upper portion, a mid-sole portion, and an out-sole portion. The upper portion can be configured to secure a foot within the footwear assembly. The mid-sole portion can be coupled to the upper portion and adapted to receive a mid-sole plate to house a lacing engine. The mid-sole plate can include a cutout to receive a button assembly to control functions of the lacing engine. The out-sole portion can be coupled to at least an inferior portion of the mid-sole portion.

In Example 23, the subject matter of Example 22 can optionally include the button assembly having a bushing and an actuator. In this example, the bushing can be received within the cutout, and the actuator can be disposed within the bushing to provide a moveable interface between the out-sole and one or more switches on the lacing engine.

In Example 24, the subject matter of Example 23 can optionally include the bushing having an actuator housing surrounded by an outer flange, wherein at least a portion of the outer flange abuts an exterior portion of the mid-sole plate.

In Example 25, the subject matter of Example 24 can optionally include the actuator housing having a recess lip extending from an interior side of the outer flange to form an actuator recess to hold the actuator.

In Example 26, the subject matter of Example 25 can optionally include the recess lip having a bushing key extending from an inferior portion of the recess lip, the bushing key adapted to mate with a corresponding bushing cutout in the cutout in the mid-sole plate.

In Example 27, the subject matter of any one of Examples 25 and 26 can optionally include the recess lip having interior retention clips to engage an interior bushing retention ridge adjacent the cutout in the mid-sole plate.

In Example 28, the subject matter of Example 27 can optionally include a superior edge of the outer flange having exterior retention clips to engage an exterior bushing retention ridge adjacent the cutout in the mid-sole plate.

In Example 29, the subject matter of any one of Examples 24 to 28 can optionally include the actuator having a plurality of actuator bodies disposed within the actuator housing, each actuator body of the plurality of actuator bodies including a switch interface adapted to interact with one of the one or more switches on the lacing engine.

In Example 30, the subject matter of Example 29 can optionally include each actuator body of the plurality of actuator bodies forming a tear-drop cross sectional shape.

In Example 31, the subject matter of any one of Examples 29 and 30 can optionally include each actuator body of the plurality of actuator bodies having an external interface extending exteriorly from the actuator housing when the actuator body is seated within the actuator housing.

In Example 32, the subject matter of Example 31 can optionally include the external interface having a set of interface ribs extend radially outward from each other to form a Y-shaped structure.

In Example 33, the subject matter of Example 32 can optionally include each rib of the set of interface ribs having a rounded outer exterior edge.

In Example 34, the subject matter of any one of Examples 23 to 33 can optionally include the bushing having an aperture to conduct light from LEDs within the lacing engine.

In Example 35, the subject matter of Example 34 can optionally include the aperture being disposed within a central portion of the actuator housing.

In Example 36, the subject matter of any one of Examples 34 and 35 can optionally include the plurality of actuator bodies having an anterior actuator body disposed on a first side of the aperture and a posterior actuator body disposed on a second side of the aperture.

In Example 37, the subject matter of Example 36 can optionally include the anterior actuator body being a mirror image of the posterior actuator body.

ADDITIONAL NOTES

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The disclosure, therefore, is not to be taken in a limiting sense, and the scope of various embodiments includes the full range of equivalents to which the disclosed subject matter is entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein, such as the motor control examples, can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. An Abstract, if provided, is included to comply with United States rule 37 C.F.R. § 1.72(b), to allow the reader to quickly ascertain the nature of the technical disclosure. It is submitted with the understanding that it will not be used to interpret or limit the scope or meaning of the claims. Also, in the above Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A method of controlling a lacing engine within an automated footwear platform, the method comprising:

receiving, on a first actuator body of an actuator, a button activation input resulting in a linear movement of the first actuator body of the actuator in a medial-lateral direction with respect to the automated footwear platform, wherein the actuator is disposed within an opening in a lower portion of the footwear platform adjacent the lacing engine; and transmitting, via the first actuator body of the actuator, the linear movement caused by the button activation input to activate a first switch embedded in a housing of the lacing engine within the footwear platform, wherein activating the first switch occurs in response to the linear movement of the first actuator body.

2. The method of claim 1, wherein the linear movement of the first actuator body occurs within a bushing portion of the actuator surrounding the first actuator body.

3. The method of claim 1, further comprising tightening, in response to the first switch activation, a lace within the footwear assembly controlled by the lacing engine.

4. The method of claim 1, further comprising:

receiving, on a second actuator body of an actuator, a second button activation input resulting in a linear movement of the second actuator body of the actuator;

transmitting, via the second actuator body of the actuator, the second button activation input to activate a second switch embedded in the housing of the lacing engine within the footwear platform, wherein activating the second switch occurs in response to the linear movement of the second actuator body.

5. The method of claim 4, wherein the transmitting the second button activation input includes flexing in a connector portion of the actuator connecting the first actuator body and the second actuator body.

6. The method of claim 5, wherein the flexing the connector portion in response to the second button activation input allows the first actuator body to remain substantially stationary in response to the second button activation input.

7. The method of claim 4, further comprising loosening, in response to the second switch activation, a lace within the footwear platform controlled by the lacing engine.

8. The method of claim 1, further comprising:

receiving, on both the first actuator body and the second actuator body of the actuator, a third button activation input resulting in a linear movement to both the first actuator body and the second actuator body of the actuator;

transmitting, via the first actuator body and the second actuator body of the actuator, the third button activation input to concurrently activate the first switch and the second switch embedded in the housing of the lacing engine within the footwear platform, wherein activating the first switch and the second switch occurs in response to the linear movement of the first actuator body and the second actuator body respectively.

9. The method of claim 8, further comprising resetting, in response to the concurrent activation of the first switch and the second switch, the lacing engine within the footwear platform.

10. The method of claim 1, further comprising illuminating a portion of the actuator in response to activating the first switch.

11. The method of claim 10, wherein illuminating the portion of the actuator includes transmitting light from the lacing engine via a light aperture portion of the actuator.

12. A method of controlling a lacing engine within an automated footwear platform, the method comprising:

receiving, on a first actuator body of an actuator, a button activation imparting a movement to a first actuator body of the actuator, wherein the actuator is disposed within a bushing in a lower portion of the footwear platform adjacent the lacing engine; and transmitting, via the first actuator body of the actuator, the movement to activate a first switch embedded in a housing of the lacing engine within the footwear platform, wherein activating the first switch occurs in response to the movement of the first actuator body.

13. The method of claim 12, wherein the movement of the first actuator body occurs within the bushing associated with the actuator, a portion of the bushing surrounding the first actuator body.

14. The method of claim 12, further comprising tightening, in response to the first switch activation, a lace within the footwear assembly controlled by the lacing engine.

15. The method of claim 12, further comprising:

receiving, on a second actuator body of an actuator, a second button activation imparting a second movement to the second actuator body of the actuator;

transmitting, via the second actuator body of the actuator, the second movement to activate a second switch embedded in the housing of the lacing engine within the footwear platform, wherein activating the second switch occurs in response to the movement of the second actuator body.

16. The method of claim 15, wherein the transmitting the second movement includes flexing in a connector portion of the actuator connecting the first actuator body and the second actuator body.

17. The method of claim 16, wherein the flexing the connector portion in response to the second movement allows the first actuator body to remain substantially stationary in response to the second physical force.

18. The method of claim 15, further comprising loosening, in response to the second switch activation, a lace within the footwear platform controlled by the lacing engine.

19. The method of claim 12, further comprising:

receiving, on both the first actuator body and the second actuator body of the actuator, a third button activation imparting a third movement to both the first actuator body and the second actuator body of the actuator;

transmitting, via the first actuator body and the second actuator body of the actuator, the third movement to concurrently activate the first switch and the second switch embedded in the housing of the lacing engine within the footwear platform.

20. The method of claim 19, further comprising resetting, in response to the concurrent activation of the first switch and the second switch, the lacing engine within the footwear platform.

* * * * *